US010682583B2

(12) United States Patent
Simmons et al.

(10) Patent No.: US 10,682,583 B2
(45) Date of Patent: Jun. 16, 2020

(54) THREE-DIMENSIONAL STAND ALONE POP UP ASSEMBLY AND METHOD

(71) Applicants: Dawn Simmons, Grass Valley, CA (US); Tor Lokvig, Grass Valley, CA (US)

(72) Inventors: Dawn Simmons, Grass Valley, CA (US); Tor Lokvig, Grass Valley, CA (US)

( * ) Notice: Subject to any disclaimer, the term of this patent is extended or adjusted under 35 U.S.C. 154(b) by 0 days.

(21) Appl. No.: 16/504,833

(22) Filed: Jul. 8, 2019

(65) Prior Publication Data

US 2019/0329145 A1 Oct. 31, 2019

Related U.S. Application Data

(63) Continuation-in-part of application No. 16/286,454, filed on Feb. 26, 2019, now Pat. No. 10,384,143, which is a continuation of application No. 16/155,751, filed on Oct. 9, 2018, now Pat. No. 10,252,177, which is a continuation-in-part of application No. 15/339,801, filed on Oct. 31, 2016, now Pat. No. 10,155,173.

(51) Int. Cl.

| | |
|---|---|
| ***A63H 33/16*** | (2006.01) |
| ***A63H 33/38*** | (2006.01) |
| ***B42D 15/04*** | (2006.01) |
| ***G09F 1/06*** | (2006.01) |
| ***A63H 33/42*** | (2006.01) |
| ***G09F 1/08*** | (2006.01) |

(52) U.S. Cl.

CPC ..... *A63H 33/16* (2013.01); *A63H 33/38* (2013.01); *A63H 33/42* (2013.01); *B42D 15/042* (2013.01); *G09F 1/06* (2013.01); *G09F 1/08* (2013.01)

(58) Field of Classification Search

CPC ..... A63H 33/16; A63H 33/38; B42D 15/042; G09F 1/06; G09F 1/08

See application file for complete search history.

(56) References Cited

U.S. PATENT DOCUMENTS

| | | | | |
|---|---|---|---|---|
| 5,628,396 | A * | 5/1997 | Weiner | B65D 5/029 206/216 |
| 2007/0115281 | A1* | 5/2007 | Litzau | G09F 1/06 345/419 |
| 2007/0165195 | A1* | 7/2007 | Lockett | F21V 1/00 353/120 |
| 2008/0053942 | A1* | 3/2008 | Cox | A47F 5/112 211/149 |
| 2008/0083146 | A1* | 4/2008 | Martin Presa | G09F 1/06 40/600 |
| 2015/0224807 | A1* | 8/2015 | Magley | B42D 15/042 40/124.14 |

* cited by examiner

*Primary Examiner* — Gary C Hoge
(74) *Attorney, Agent, or Firm* — John C. Merchant

(57) ABSTRACT

In accordance with the present invention, several stand-alone pop up assembly embodiments and method for making the same are provided comprising folding planar walls, center partition and frictional opening and closing mechanism.

17 Claims, 29 Drawing Sheets

154a, 154b 155a, 155b, 155c,
155d, 155e, 155f

156

THREE-DIMENSIONAL STAND ALONE POP UP ASSEMBLY AND METHOD

CROSS-REFERENCE TO RELATED APPLICATION

The present non-provisional application is a Continuation-in-Part of commonly assigned Continuation application Ser. No. 16/286,454 filed Feb. 26, 2019, of a commonly assigned Divisional application Ser. No. 16/155,751, filed Oct. 9, 2018, of a Continuation-in-Part Application Ser. No. 15/339,801, filed Oct. 31, 2016, of parent application Ser. No. 14/530,344, filed Oct. 31, 2014, which claims the benefit of Provisional Application having Ser. No. 61/898,359, filed Oct. 31, 2013, and all entitled THREE-DIMENSIONAL STAND ALONE POP UP ASSEMBLY AND METHOD which prior related applications are incorporated herein by reference in their entirety.

FIELD OF INVENTION

The present invention relates generally to three-dimensional stand-alone pop up assemblies and methods for making the same. The assemblies and methods described relate specifically to three-dimensional pop up and fold flat structures such as those traditionally used in greeting cards, books, package decorations, and promotional displays.

BACKGROUND

For the 2012 season, U.S. consumer spending on Christmas decorations was projected to be $6.9 billion dollars and expected to grow by 3.4 percent during the holiday season 2013. In line with the growing number of dollars spent on decorations is also the growing number of articles on how to store holiday decorations. Primary research has unveiled that some consumer collectors of particular holiday items such as the ceramic or pressed paper and cardboard Christmas village sets either keep the village pieces out all year long or unpack them every other year due to the cumbersome task of assembling the village and taking it down each year. Despite the increase in consumer holiday decoration spending dollars, some retailers expressed that selling holiday décor can be a challenge due to direct consumer comments of storage problems. Retailers are also concerned about the amount of retail space required to display particular items (particularly three-dimensional objects and structures).

Typical pop up assemblies, like those used in cards and books, traditionally have an extended gatefold base which extends beyond the footprint of the structure. The structure is positioned along the center line with the walls of the structure glued to the base. When the pop up structure is in a closed position, the extended base is folded along a center line and the structure is folded flat between the sides of the base and is therefore hidden from view. When the base is opened, it pulls on the walls of the structure and pushes up on a vertical center support attached to a horizontal spreader which folds out the walls and makes the pop up structure stand up. The extended base must be held in open position or the pop up will collapse shut. To close the pop up, the extended base is folded shut such that the center support pulls down the spreader allowing the walls to fold closed. The pulling and pushing of the spreader during opening and closing causes stress on the paper walls and, for this reason, the center support requires reinforcement or it will bend or tear over time and use. For this reason, tabs are usually added to the center support and the tabs are folded back and glued to the center support to provide reinforcement and stiffness.

To accommodate the attached walls of the structure and keep the pop in the open position, such prior art pop up structures utilize a large extended base which must be held in the open position by the user (or by placing the structure on a flat surface and applying weighted items on the base ends to hold the extended base in the open position). Otherwise, the elastic nature of the materials will tend to pull the base into a closed position along the center line causing the center support to move downward and fold the walls.

Another drawback of prior art pop up structure is that when the structure is in closed position it is entirely hidden from view by the extended base. This creates a problem for consumers who must rely on photographs of displays in order to determine the indicia and other design amenities of the structure prior to opening (or purchasing). Further, the consumer may not want an extended base but rather have a pop up structure which can stand alone on a shelf or otherwise be hung from a line. The extended base also prevents the user from displaying several pop up structures adjacent to one another as there must be room to accommodate the base of each structure. While there are a variety of foldable stand-alone structures (made of card stock or other materials) which may lay flat when disassembled and otherwise be pieced together into a three dimensional stand up structure without an extended base, such assembled prior art structures are not pop up structures in that they cannot be easily moved between a closed substantially flat position and an open three dimensional position without constructing and deconstructing the structure. For example, a prior art structure having multiple panels and base may be constructed to stand alone or deconstructed to fold flat, but it does not move easily between the two positions without considerable effort on the part of the user.

Examples of prior art pop up structures which do not use the extended base approach include that described in U.S. Pat. No. 8,418,384 (First Inventor Jin, granted Apr. 16, 2013) as a pop up musical greeting card using a top extended center support mechanism to activate a musical sound module and/or lights when in the open position. While this design eliminates the problems associated with the extended base, it requires that the center support member (or mechanism) to protrude outward and extend away from the structure. This protruding extended support is not aesthetically pleasing or consistent with the design theme.

Again, the disadvantages of the prior art pop up structures are numerous in that they either rely on an extended base which must be held open and/or a protruding extended support member which is unsightly. Such extended bases or protruding members require additional space to display and to store. They do not allow for the user to view the exterior aesthetic features of the structures when in the closed position because they are covered by the extended base or card cover when closed thus making it difficult for a user to sort and/or identify items folded flat in a box or other container. They have limited lighting options because lighting must be made small enough to allow the structure to fold flat when in the closed position and/or there is no accommodation in the center support or base to allow a tea light or other larger lighting object to be placed in the structure. The lighting option described in the Jin patent (identified above) is particularly limited in size and duration of light (lasting only 10 to 20 seconds in the open position), and cannot be easily replaced. In fact, most prior art pop up structure designs make no accommodation whatsoever for internal lighting. Those relying on candles tend to be a fire hazard because there is no accommodation within the center support structure or base to hold the light away from flame. The very nature of most prior art designs, which tend to collapse unless the extended base is held open, is unsafe for use with open flame. Those relying on temporary battery powered lighting are limited by space within the structure.

What is needed is a stand-alone pop up structure (or "assembly") which does not rely on an extended base or protruding extended support member and which alleviates other disadvantages associated with the prior art.

SUMMARY OF INVENTION

In accordance with the present invention, a stand-alone pop up assembly and method for making the same is provided which resolves problems associated with prior art. The assembly consists, generally, of an outer structure comprising two or more wall panels connected with an internal base permanently attachable to the outer structure at a bottom edge of the first panel wall at one edge of the internal base and temporarily attachable to the bottom edge at the second panel wall at a second edge of the internal base opposite the one edge. A roof structure is formed from a square or rectangular plane divided in half by a score line forming a first planar side and a second planar side, the first planar side and the second planar side meeting at the score line forming a roof ridge apex.

This embodiment also includes a roof interface component having a rectangular panel including a length and width, divided by a score line along the length centered on the width creating a lower support panel and an upper glue panel, a rectangular planar neck portion centered and extending above the upper glue panel forming at least a top glue panel. The upper glue panel is permanently attachable to the inner surface of the first planer side of the roof structure, the top glue panel is permanently attachable to the inner surface of the second planar side, and the assembly is moveable between a first position being substantially flat folded closed into a one dimensional structure and a second position enfolded into a three dimensional structure by manipulating the outer structure and the internal base. This embodiment provides that the roof interface component swivels during the movement to the three dimensional structure, thereby positioning the roof structure over the upper portions of the first and second panel walls.

Alternatively, the roof is attached to the outer structure by a second glue tab integrated with an insert tab, instead of the roof interface component. The second glue tab is permanently attachable to a bottom edge of the rear side of the roof structure and is insertable into a slot cutout at the top edge of the roof interface tab, and when the structure moves to the second position, the insert tab is slid within the slot cutout during movement into the three dimensional structure, thereby positioning the roof structure over the upper portions of the first and second panel walls. The overall assembly accommodates a variety of lighting and sound features and can be configured in a variety of three dimensional stand-alone pop up designs.

Also disclosed is a pop-up assembly having a base component with four adjacent planar panels including a first panel with first folding edge (or score line), a second panel having a second panel edge connected to the first panel along the first folding edge and having a second folding edge opposite the first folding edge, a third panel having a third panel edge connected along the second folding edge and having a third folding edge opposite the second folding edge, a fourth panel having a fourth panel edge connected along the third folding edge and having a fourth folding edge opposite the third folding edge, and accessory interface component separated by a fifth folding edge, the accessory interface component connected along the fourth folding edge and comprising one or more slots for accepting an accessory, an accessory having a body portion extending from a sliding interface comprising an elongate insert tab enabled to insert into the one or more slots and an accessory attachment tab, and wherein all of the panels and accessory interface are folded in the same direction along the first, second, third and fourth folding edges, the accessory interface component being folded along the fifth folding edge, the elongate insert tab inserted through the one or more slots, thereby enabling the base to pop out into a three dimensional structure with the body of the accessory supported by the base and enabling the base and accessory to fold back into two dimensions.

Also described is four sided pyramid pop-up assembly and method for making the same. This embodiment of the pop-up assembly has four adjacent triangular exterior planar panels making up the exterior walls of the four sided pyramid. The first panel having a first folding edge (or "score line"), a second panel having a second panel edge connected to the first panel along the first folding edge and having a second folding edge opposite the first folding edge, a third panel having a third panel edge connected along the second folding edge and having a third folding edge opposite the second folding edge, a fourth panel having a fourth panel edge connected along the third folding edge and having a fourth folding edge opposite the third folding edge, a center partition panel connected along the fourth folding edge, and comprising one or more slots for accepting a frictional sliding tab of an opposing center partition panel extending from the opposite interior corner from the center partition panel, wherein all the exterior planer panels as well as the center partition panel are folded in the same direction along the first, second, third, and fourth folding edges (score lines), the center partition panel being folded along the fourth folding edge and extending from the one interior corner toward the opposite interior corner, an opposing center partition panel having frictional strap affixed to the interior surface of third exterior panel and adjacent the second folding edge and extending toward the opposite interior corner such that a curved protruding frictional sliding tab extends through the one or more receiving slots of the center partition panel thereby enabling the pyramid to pop out into a three dimensional structure and resist collapse and also enabling the pyramid to fold back into two dimensions.

DETAILED DESCRIPTION OF THE PREFERRED EMBODIMENTS

The Figures are for purposes of illustrating several embodiments of a pop up assembly consistent with the principles of the present invention and are not for purposes of limiting the same.

Figure 1A:
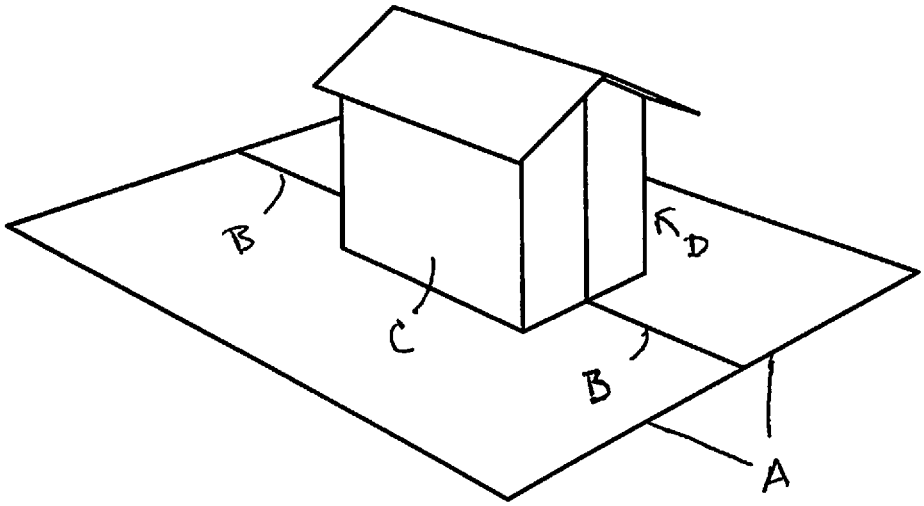
FIGS. 1A-1C are perspective views of an example embodiment of a traditional prior art pop up assembly in the shape of a house moving from an open second position toward a substantially closed first position.
Figure 1B:
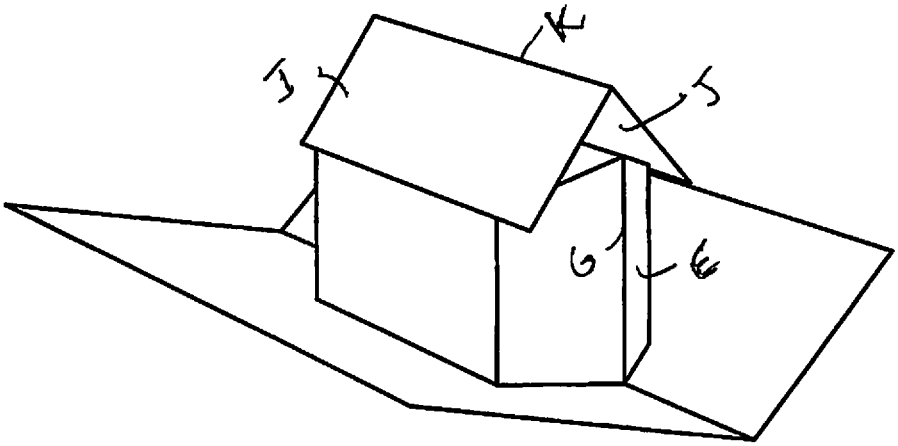
Figure 1C:
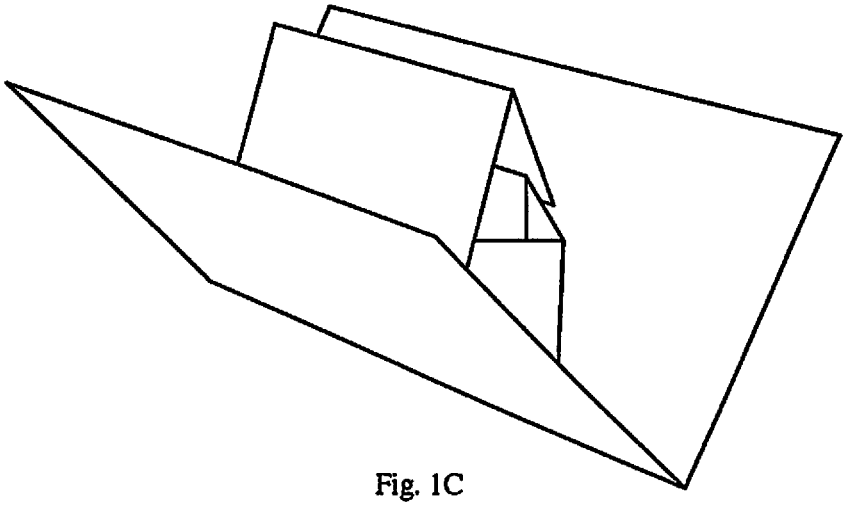

FIGS. 1A-1C are perspective views of an example embodiment of a traditional prior art pop up assembly in the shape of a house moving from an open second position toward a substantially closed first position. Like those assemblies traditionally used in cards and books, the assembly has an extended two-panel gatefold base (A) with a single center fold line (B). The bottom edge of the opposing front (C) and back (D, not shown) wall panel are glued to the top surface of the base (A) and the structure folds open (i.e. pops up) when the base is opened. The gatefold base and center fold line found in pop up books may also include bindery. FIG. 1A shows the assembly in the open second position. FIGS. 1B and 1C shows the assembly with the extended base folding along the center fold line (B) toward a substantially closed first position. Sidewalls (E) and (F, not shown) folds outward at their respective center fold lines (G and H). The roof panels (I and J) collapse together along the roof center fold line (K)

Figure 2A:
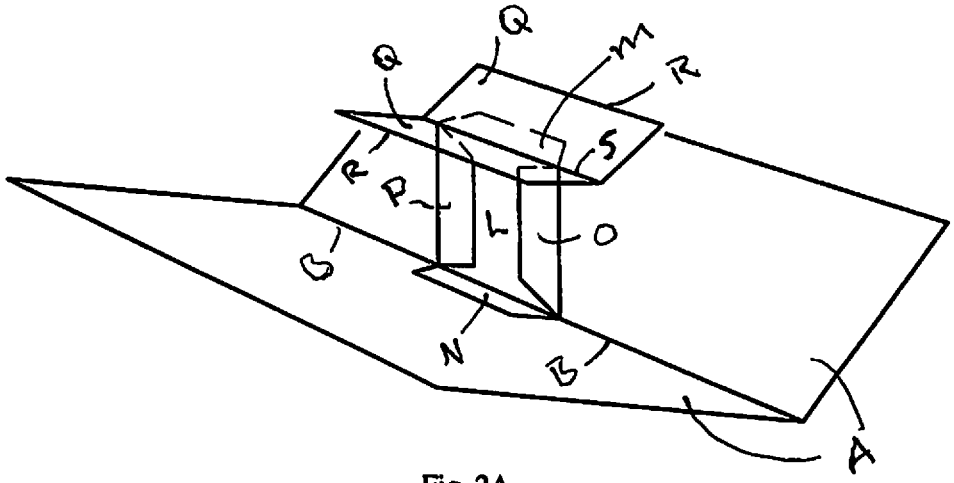
FIG. 2A is a perspective view of the structural elements of an example embodiment of the traditional pop up assembly depicted in FIGS. 1A-1C.
Figure 2B:
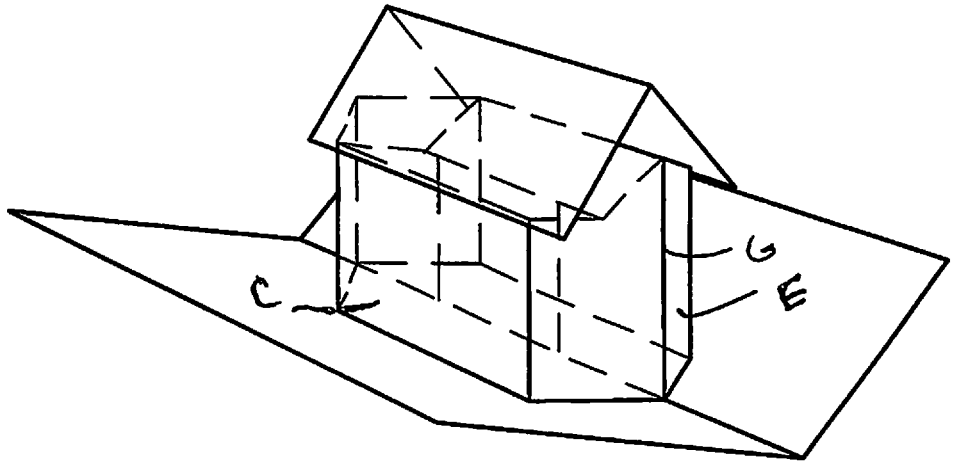
FIG. 2B is a perspective view of the traditional prior art pop up assembly depicted in FIGS. 1A-1C with both internal and external elements shown.

FIG. 2A provides a perspective view of the mostly internal structural elements of the example embodiment of a traditional prior art pop up assembly (as depicted in FIGS. 1A-1C) while FIG. 2B is a perspective representation of those structural elements in relationship to external elements (such as the panel walls and roof). Note that not all the elements depicted in FIG. 2A are internal. The extended base (A) extends beyond the outer boundaries of the outer structure walls (or panels) when in the open position and otherwise serves to envelope (sandwich or hide) the other elements, including the wall panels, when the assembly is in the first closed position.

The internal structural elements shown in 2A include the two panel extended gatefold base (A) having left and right sides which fold together along the center fold line (B), a center support member (L) having glue tabs (M and N) and reinforcement tabs (O and P), and a spreader (Q) having left and right flaps each side having an outboard edge (R). In the example shown, the extended base (A) has a single (in this case a center) fold line (B) defining the two equally sized sides. The spreader (Q) also has a center fold line (S) defining two equally sized flaps. One of the center support element glue tabs (N) is attached to the extended base immediately adjacent the base center fold line (B). The other center support glue tab (M) is attached to the spreader (Q) immediately adjacent the spreader center fold line (S). As shown in FIG. 2B, each side of the extended base (A) is attached to the bottom edge of opposing panel walls (C and D, not shown). The outboard edges of the spreader flaps are attached with the interior surface of opposing panel walls (C and D) of the outer structure while the remaining two walls (E and F, not shown) each have center folds (G) which allow the outer structure to collapse when the assembly is in the closed position. When the structure is in an open position (referred to herein as the "second" position—See FIG. 1A), the two sides of the extended base (A) are pulled into horizontal alignment with one another. When the structure is in a closed position (referred to herein as the "first" position—as substantially shown in FIG. 1C), the two sides of the extended base (A) are folded together along the base center fold line (B) so they are substantially parallel and overlap one another with the outer structure folded flat in between.

When the extended base (A) is pulled open (i.e. moved from first to second position), the center support element (L) which is substantially perpendicular to the base moves upwards relative to panel walls of the structure, thus pushing open the spreader flaps (Q) connected with the opposing walls. When the extended base (A) is folded closed (i.e. moved from second to first position), the center support (L) is pulled downward relative to the walls of the outer structure which in turn causes the spreader flaps (Q) to fold inward and collapse the structure. This pulling and pushing of center support against the spreader and spreader flaps against the walls of the structure during opening and closing causes stress to the center support element (as well as to the joints or connections) and, for this reason, the center support, spreader and connections often require reinforcement or they will bend or tear over time and use. For this reason, support tabs (0 and P) are usually added to the center support and these tabs are folded back and glued to the center support element (L) providing reinforcement and stiffness. As previously noted, the extended base (A) must be held in the open position or the pop up will collapse shut as the elasticity of the materials along the center folds will cause the structure to collapse inward rather than extend outward.

Figure 3A:
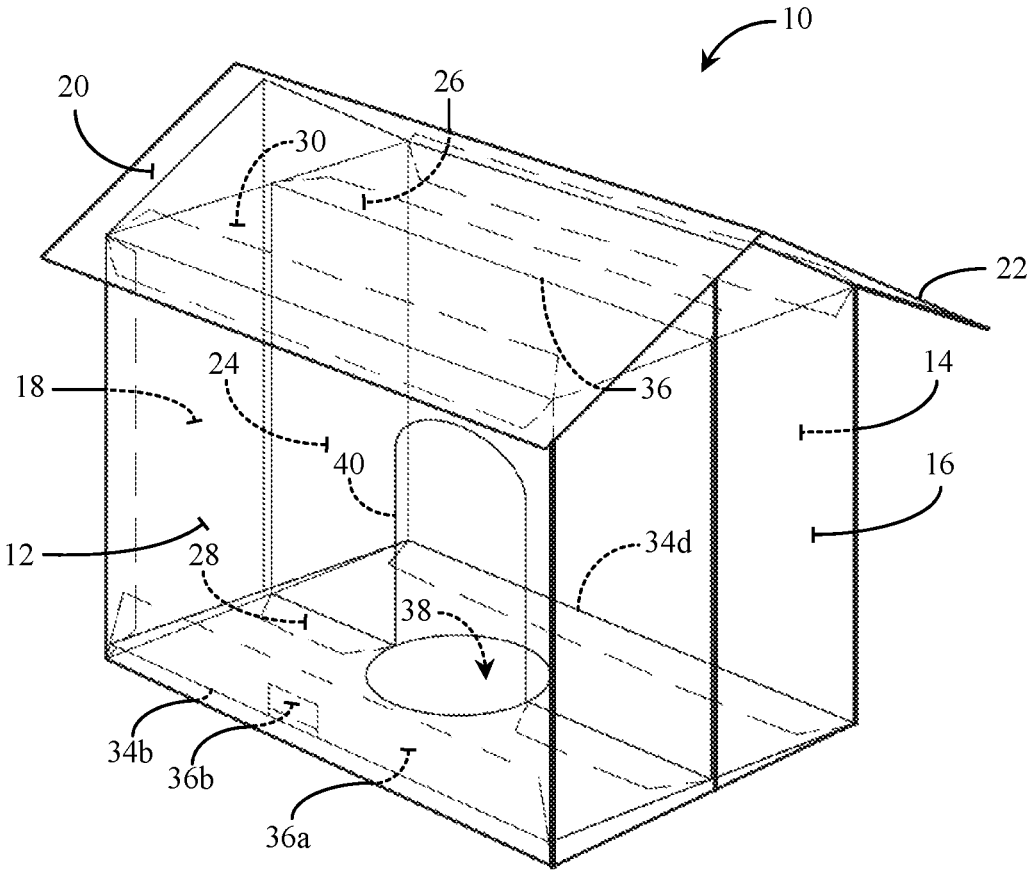
FIG. 3A is a perspective view of an embodiment of a pop up assembly consistent with the principles of the present invention in the form of a house.
Figure 3B:
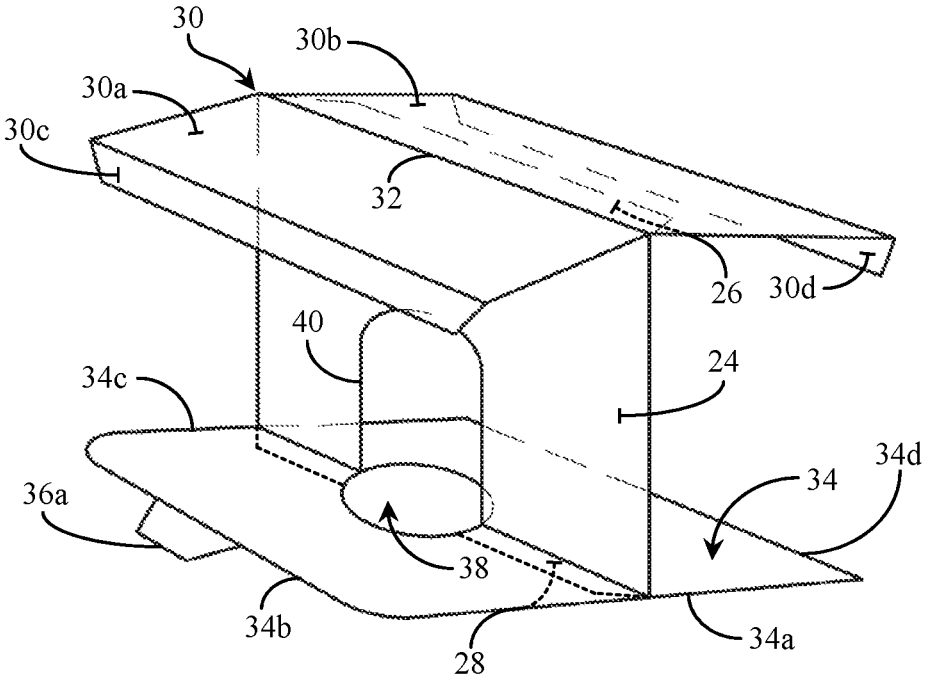
FIG. 3B is a perspective view of the internal structural elements of a pop up assembly consistent with the principles of the present invention.

FIG. 3A is a perspective view of an example of preferred embodiment of a pop up assembly 10 in the form of a house which is consistent with the principles of the present invention. FIG. 3B is a perspective view of the support structure of the assembly, while FIG. 3A shows outer structure with the support structure elements contained therein. Looking at FIG. 3A, the outer structure elements consist of opposing front 12 and back 14 panel walls, side walls 16 and 18, as well as well as roof flanges 20 and 22 each having interior and exterior surfaces and generally connected as a single piece of material or by way of glue tabs or other connection means. Looking at FIG. 3B, the support structure includes a center support member 24 having front and back sides, a top edge glue tab 26, a bottom edge glue tab 28, a spreader 30 having a center fold line 32 defining two spreader flaps (30*a* and 30*b*) each having one or more outboard edge flaps (30*c* and 30*d*), and an internal base 34 having top and bottom sides, three or more edges (34*a*, 34*b* and 34*c*), and anchoring means 36 (in this case a tab 36*a* extending from the internal base 34 configured for insertion into a corresponding slot or pocket (see 36*b* on FIG. 3A) located at or near the bottom edge of one or more front, back or side walls of the outer structure.

As shown in FIG. 3A, the outboard edges 30 of the spreader flaps (30*a* and 30*b*) are connected at with the interior surfaces of opposing front 12 and back 14 wall panels. The top edge glue tab 26 of the center support 24 is connected with the bottom surface of the spreader 30 adjacent the spreader fold line 36. There are various options for connecting the bottom edge of the center support 24 with the internal base 34. For example, the bottom edge of the center support 24 may be connected with the top surface of the internal base 34 by way of a bottom edge glue tab 28 (as shown in FIG. 3A) or, alternatively, the bottom edge of the center support 24 can extend to form the internal base (making the center support 24 and internal base 34 a contiguous piece) One or more of the three or more edges of the internal base 34*a*, 34*b* and 34*c* are connected with or, preferably, extends into one or more anchoring means (such as tab 36*a*) configured for insertion into a corresponding anchoring means (such as slot 36*b*) located at or near the bottom edge of one or more front, back or side walls of the outer structure.

Note that the example embodiment shown in FIG. 3A, has a single tab 36*a* extending from an edge 34*b* of the internal base corresponding with the front panel wall 12 of the house structure. This anchoring means keeps the internal base anchored in a perpendicular orientation to the wall panels when the assembly is in the open second position. The opposite edge of the internal base 34*d* is permanently (through glue tab or other equivalent means) or temporarily (through tab and slot or other equivalent means) anchored at the base of the back panel wall 14 of the outer structure. When the assembly moves from the open position to the closed position, as later described, the anchoring means on one or both sides will be disengaged to allow the internal base to tilt and fold up into the outer structure. In a preferred embodiment, as shown in FIGS. 3A and 3B, edge 34*b* of the internal base is permanently connected with the base portion of the back panel wall 14 of the outer structure thus creating a hinge upon which the internal base folds when the assembly is closed.

It should also be noted that the internal base 34 is made of "heavier" or "weighted" materials such as heavy card stock, sheet plastic or equivalent material so that the stresses caused by the elasticity along fold lines and connections between other elements does not cause the base to break or crease but will instead maintain a relatively flat shape during and after use. If the internal base is made of light card stock, it is likely to fold, break or warp after multiple uses.

Figure 4A:
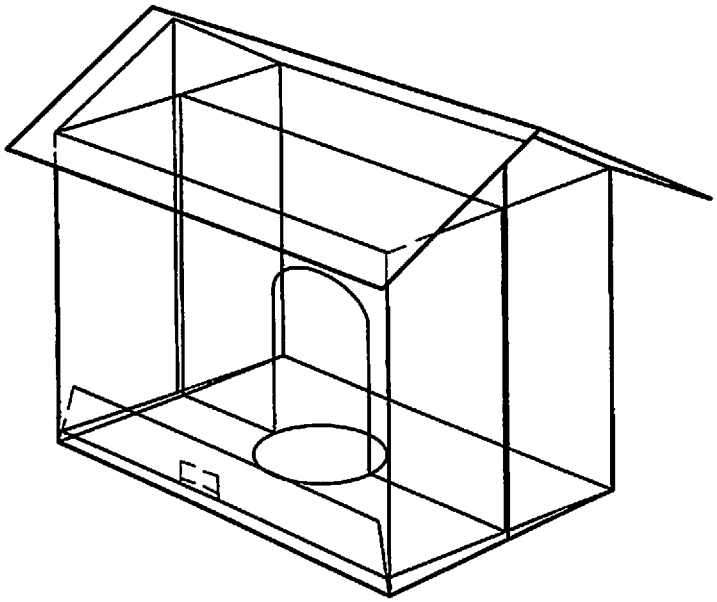
FIGS. 4A-4C are several views of a preferred embodiment of a pop up assembly consistent with the principles of the present invention in the form of a house. The several views show the internal structural elements relative to external elements as the assembly moves from a second open position to a closed first position.
Figure 4B:
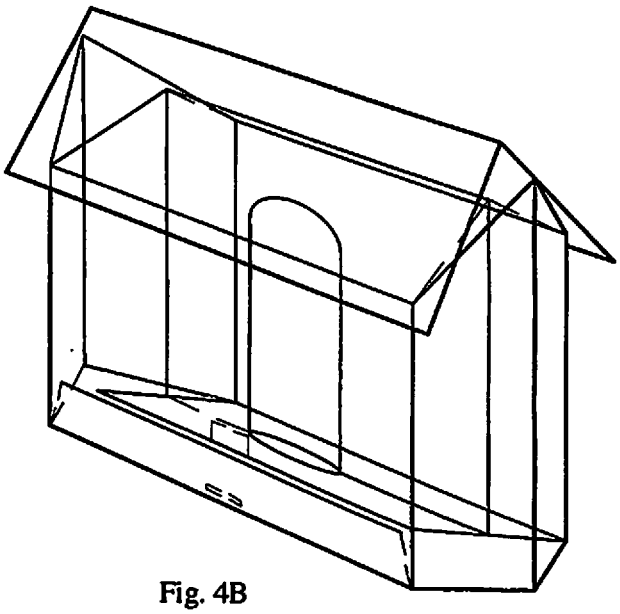
Figure 4C:
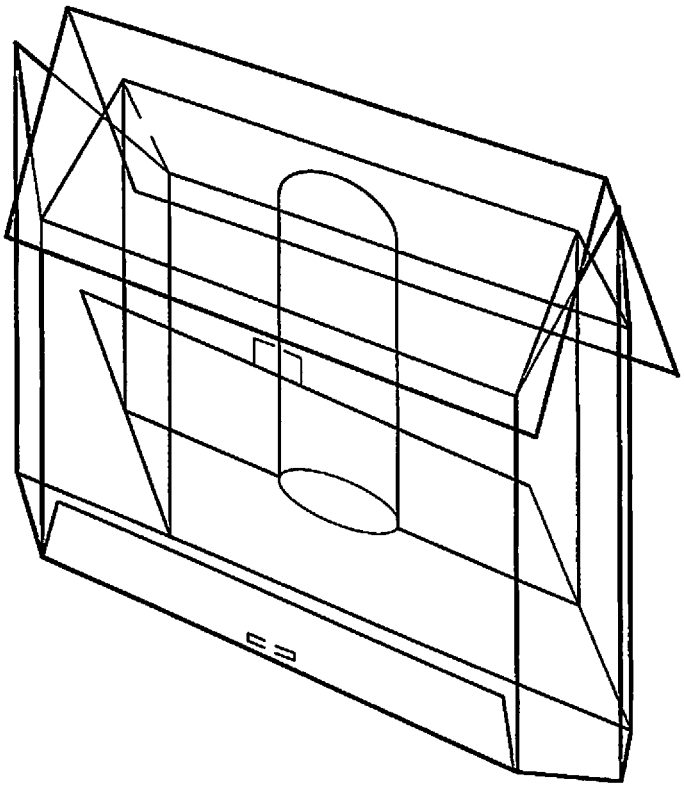

FIGS. 4A-4C are perspective views of the example embodiment of the pop up structure shown in FIG. 3A moving from an open second position to a substantially closed first position. FIG. 4A shows the embodiment in second open position. To closing the assembly, the anchoring means (in this case tab 36*a* removed from slot 36*b*) disengaged and the internal base 34 is tilted such that edge 34*b* extend up into the assembly parallel with the center support element 24 and between the opposing panel walls (see FIGS. 4B and 4C). As shown, the internal base 34 is attached with the center support 24, the center support being attached by glue tab 26 with the spreader 30, the two spreader flaps 30*a* and 30*b* being attached to interior surfaces of opposing front 12 and back 14 panel walls via spreader outboard edge tabs 30*c* and 30*d*. As the internal base 34 is pushed up into the structure, the center support 24 moves upward collapsing the opposing spreader walls (30*a* and 30*b*) inward to the closed (first or "folded flat") position. To open the assembly (i.e. move the structure from the first position to second position), the internal base 34 is pulled downward, tilting on the hinge at edge 34*d* into a horizontal position relative to the vertical center support 24 and secured by anchoring means 36. The downward tilting motion of the internal base pulls down on the center support 24 which, in turn, causes the spreader flaps (30*a* and 30*b*) to push the opposing front 12 and back 14 walls outward and into the open (second) position. (See FIG. 4A).

Importantly, the motion of the center support member 24 during the opening and closing of the assembly is in the opposite direction to the motion the center support member L takes to open and close the traditional prior art pop up structures (where the center support member L is moved upward to cause the spreader to push open the walls and downward to cause the spreader to close the walls). The combination of the heavy card stock center support connected with a heavy (or reinforced) internal base with anchoring means enables the inventive assembly to open and stand-alone without the aid of an extended base or protruding extended members. The inventive assembly does not distribute as much stress on the center support member therefore eliminating the need for center support tabs (O and P). Further, that the internal base moved up into the outer structure makes the assembly smaller and allows the user (or consumer) to see the exterior features of the assembly when in the closed position.

Figure 5A:
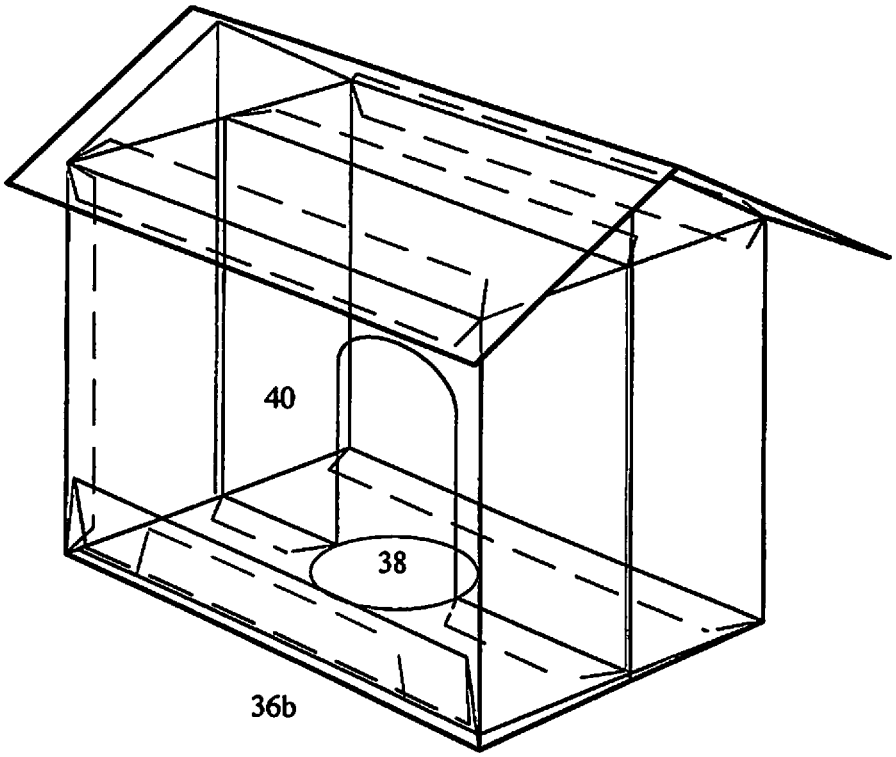
FIG. 5A is a perspective view of an alternative embodiment of a pop up assembly consistent with the principles of the present invention in the form of a house.
Figure 5B:
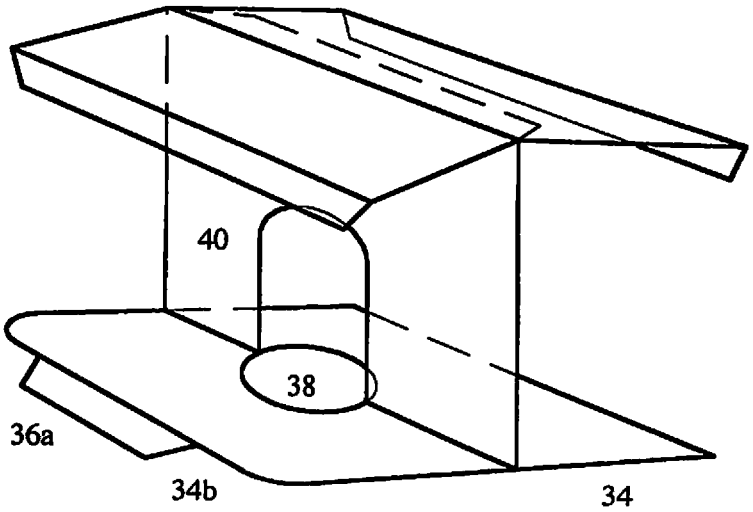
FIG. 5B is a perspective view of the internal structural elements of an alternative embodiment of a pop up assembly consistent with the principles of the present invention.
Figure 5C:
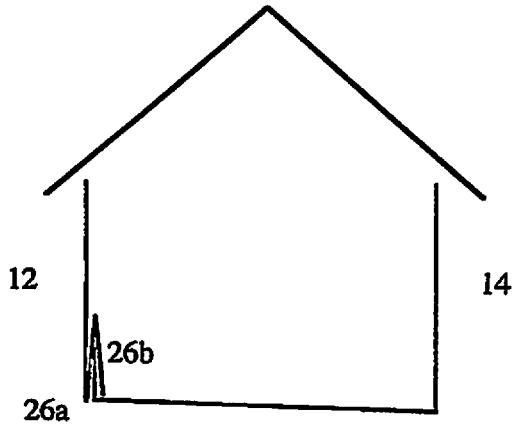
FIG. 5C is a side cutaway view of an alternative embodiment of a pop up assembly highlighting the alternative locking mechanism shown in FIGS. 5A and 5B.

FIGS. 5A-5C show perspective views of an example embodiment of the assembly similar in design to that of FIGS. 3A and 3B but with an alternative anchoring means. Looking at FIGS. 5A and 5B, the alternative anchoring means consists of an elongated tab 36*a* extending from edge 34*b* of the internal base 34 (see 5B) which is positioned within a pocket 36*b* (see 5A) located at the base portion of the interior surface of the front 12 panel wall. This pocket may be fashioned by way of folding an extended bottom portion of the front 12 panel wall and securing it with the interior surface of the wall at the ends thus creating a pocket (space) in which the extended tab 36 may be easily secured. FIG. 5C is a cut away side view of the assembly showing tab 36*a* positioned within the pocket 36*b* created by the folded extended panel wall 12.

There are a variety of options for anchoring the internal base 34 in the open position. In alternative embodiments (not shown) multiple corresponding slots may be cut into the side walls to accept the one or more anchoring tabs extending from the internal base. A combination of tab and pocket anchoring means may be utilized with the goal being that the internal base 34 is temporarily secured such that the assembly is held open without relying on an extended external base being held open as us required with the traditional pop up structure (shown in FIG. 1A). Again, anchoring pockets or slots may positioned at the base portion the wall panels which correspond to tabs extending from the internal base. In other embodiments, an equivalent form of anchoring mechanism may be employed to temporarily lock the internal base in position, for example hook and loop, snaps, temporary glue tabs (i.e. sticky tabs) or other options known in the industry. In some alternative embodiments, the internal base may extend beyond the sides of the house structure but, in order to assure that the base (internal and external) may tilt and slide up into the interior of the assembly when in closed position, the internal may not extend beyond the side walls. Although the present invention is designed to eliminate the need for an extended base to keep the structure in open position, the present invention may otherwise utilize or sit within a larger base when desired. For example, one or more structures may sit within a larger base that provides an aesthetically pleasing foreground or background (such as in a Christmas scene) or to provide a base for positioning of multiple structures (houses positioned on a hill, for example).

The internal base and center support elements shown in the figures are configured to accommodate replaceable internal lighting, such as tea lights, battery powered lights and the like. For example, the embodiments shown in FIGS. 3A-3B, 4A-4C, and 5A-5B have a round cut out 38 in the internal base with round cut out in the corresponding external base large enough to fit the circumference of a round tea light. The center support 24 has an arch shaped 40 cut out to accommodate the height of a small light or bulb. When the structure is in the open position, the tea light may be placed therein without worry that a hot element or bulb will burn or otherwise compromise the structure. These lighting components may be easily replaced or removed when the structure is to be closed. Likewise, various electronic components may be accommodated by the inventive assembly such as electronic components used to play sound, activate lights or perform other special effects or a combination thereof. Electronic components may include, but are not limited to LED lights, a printed circuit board with microprocessor, an integrated circuit ship, a controller, a power source, a speaker, a switch, a memory device, and one or more digital files stored on the memory device. Further, because the inventive structure does not need an extended base to stay open, accommodation can easily be made for hanging as an ornament or as another type of hanging decoration. For example, an assembly may include a hook or holes designed for stringing. For such purpose, the base may be solid with or without internal access flap.

Figure 6:
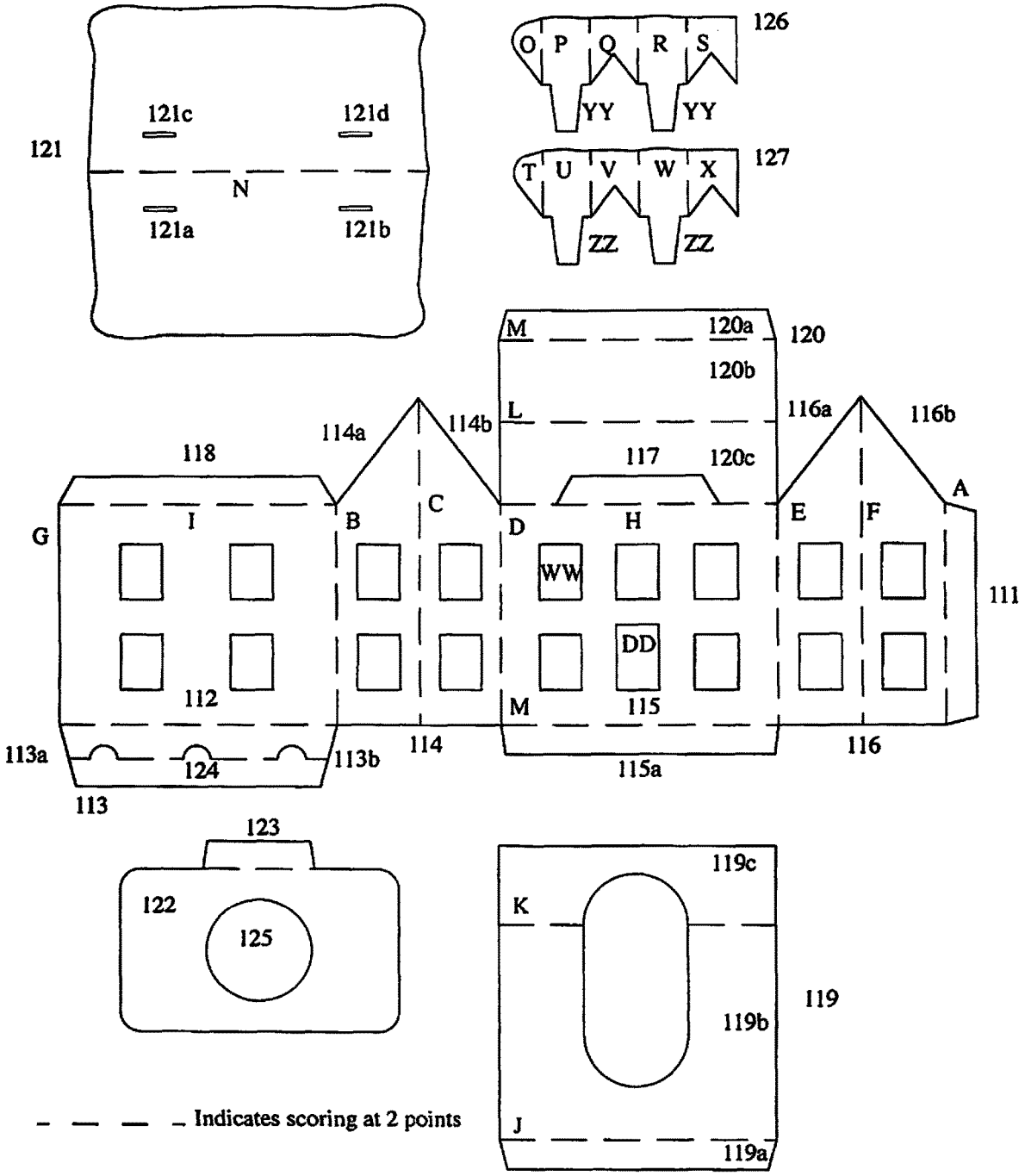
FIG. 6 is an example template showing the design and shape of the various elements associated with a first example embodiment of a four-panel pop up assembly consistent with the principles of the present invention in the shape of a house.
Figure 6:
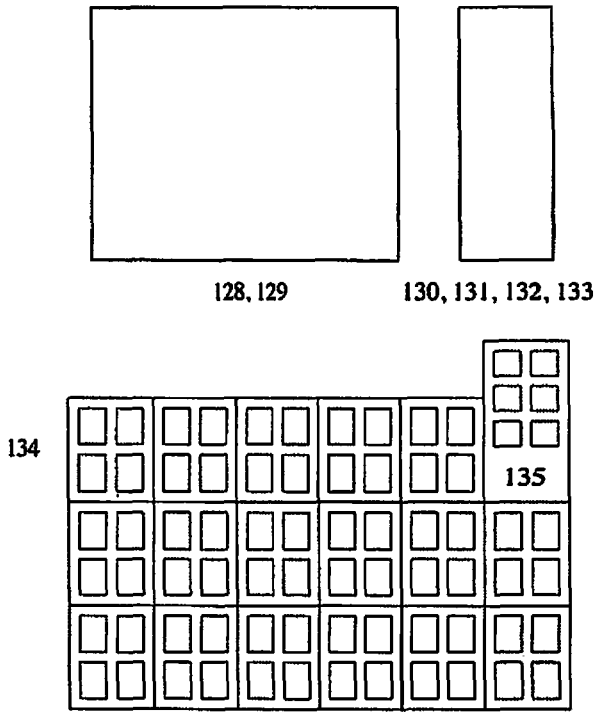

FIG. 6 shows a stencil outlining the elements of an example four-panel paper pop up assembly consistent with the principles of the invention and in the form of a house. The various elements are marked as follows:

111 (back wall panel side glue tab)
112 (back wall panel)
113 (back wall panel bottom back glue tab with slot for locking tab)
114 (left side wall panel)
114*a* (left of left side wall panel)
114*b* (right of left side wall panel)
115 (front wall panel)
116 (right side wall panel)
116*a* (left of right side wall panel)
116*b* (right of right side wall panel)
117 (front wall panel top glue tab)
118 (back wall panel top glue tab)
119 (center support member with two scores and two glue tabs)
120 (spreader with center score and one glue tabs)
121 (roof top with center score)
122 (internal base)
123 (anchoring tab)
124 (anchoring slot)
125 (rounded opening for battery operated tea light)
126 (chimney)
127 (chimney)
128, 129, 130, 131, 132, 133 (internal vellum pieces)
134 (exterior window overlays)
135 (exterior door overlay)
G (end of back wall)
A, B, C, D, E, F, H, I, J, K, L, M, N (score or fold lines)
O, P, Q, R, S, T, U, V, W, X (wall sections of chimneys)
YY, ZZ (chimney tabs into roof 21)
- - - - - - Indicate scoring at 2 points Note that there are a variety of methods and materials known and used in art to attach elements to each other such as hot glue, craft glue, spray adhesives, tape, gels, magnets, staples, hook and loop (i.e. Velcro) and other adhesive substances or fasteners. Glue is a preferred adhesive as it is very effective and does not deteriorate like tape over time. Velcro is an option for use in the tab slot closure.

One example of a method for making the structure shown in FIG. 6 consists of the following steps:

Tabs 113*a* and 113*b* folded to the inside of 112 and secured. Vellum 128 and 129 are attached to the interior surface of wall panels 112 and 115. Vellum 130, 131, 132, and 133 are attached to the inside of left side wall panel 114*a*, 114*b*, and right side wall panel of 116*a*, 116*b*. Center support member tab 19*c* is lined up and attached to the bottom tab 115*a* of front wall panel 115. Internal spreader is a continuation of front wall panel 115 consisting of die cut tab 117, scores L and M. Tab 120*a* is aligned with score I at score M with the narrow portion of 120*a* score M facing down towards the base of 112. Tab 120*a* is attached just below score I. Tab 119*a* at score J is aligned and attached to just off center of score L on side 120*b*. The method of attaching in this sequence and just off center to score N is important to the proper function of the internal parts.

Positioning the center support member to just off center of the center fold on the spreader allows the spreader to fold correctly when in the first folded flat position. Since the spreader needs to fold in an upward arch when placed in the first folded flat position, this off-center-to-score attachment avoids any binding or hindrance that could be created if the attachment were at the spreaders exact center. The just off center placement design of the center support member attachment to the spreader allows the pop up to fold flat while still functioning as needed when in the second open position.

Base 122 is attached to section 119*c* on internal center support leaving one-half of the base unit unattached. Tab 111 is attached to the inside of 112 at G with score A lined up directly to the right edge of G. Tab 117 is lined up to score marks on the inside of roof 121 located just below 121*a* and 121*b*. While in this position, adhesive is applied to tab 117 and attached. Adhesive is then applied to tab 18 and attached in the same manner to the score lines on the inside and just below 121*c* and 121*d*.

Chimney 126 is folded on the score lines with adhesive applied to section O and attached to the inside of section S to make a square. Similarly, chimney 127 is folded on the score lines with adhesive being applied to section T and attached to inside of section X to make a square. Chimney tabs YY and ZZ are inserted into roof 121 at slots 121*a*, 121*b*, 121*c*, 121*d*.

The seventeen overlay windows 134 in FIG. 6 continued are lined up precisely and adhered to the exterior structure at the designated window openings WW.

The door 135 is lined up precisely with the door opening DD on the front of wall 115 creating a polished framed effect.

Wall 112 acts as an anchor for 113*a* and 113*b* which collectively create the pocket-slot design 124. Base tab 123 tabs into the slot created by the combined attachment of 113*a* 113*b* to wall 112.

Importantly, the inventive design requires only one wall of the outer structure to be connected to the internal base of the support structure in order to function as a complete and independent unit as a three-dimensional stand-alone structure in the open position and as a complete and independent unit as a flat object in the second closed position. The prior art designs (for example, that shown in FIG. 1B) require that opposing walls of the assembly be connected to the extended base in order to cause the center support mechanism to move up and down when the structure is opened and closed. The unique design of the inventive assembly effectively eliminates the need for a double wall attachment at the outer structure or an extended base to assist in opening the structure. Elimination of the extended base allows for the aesthetic features of the assembly to be viewed when in the first folded flat position (i.e. when stored), and also allows the assembly to function as a self-contained stand-alone object when in the second open position.

Figure 7:
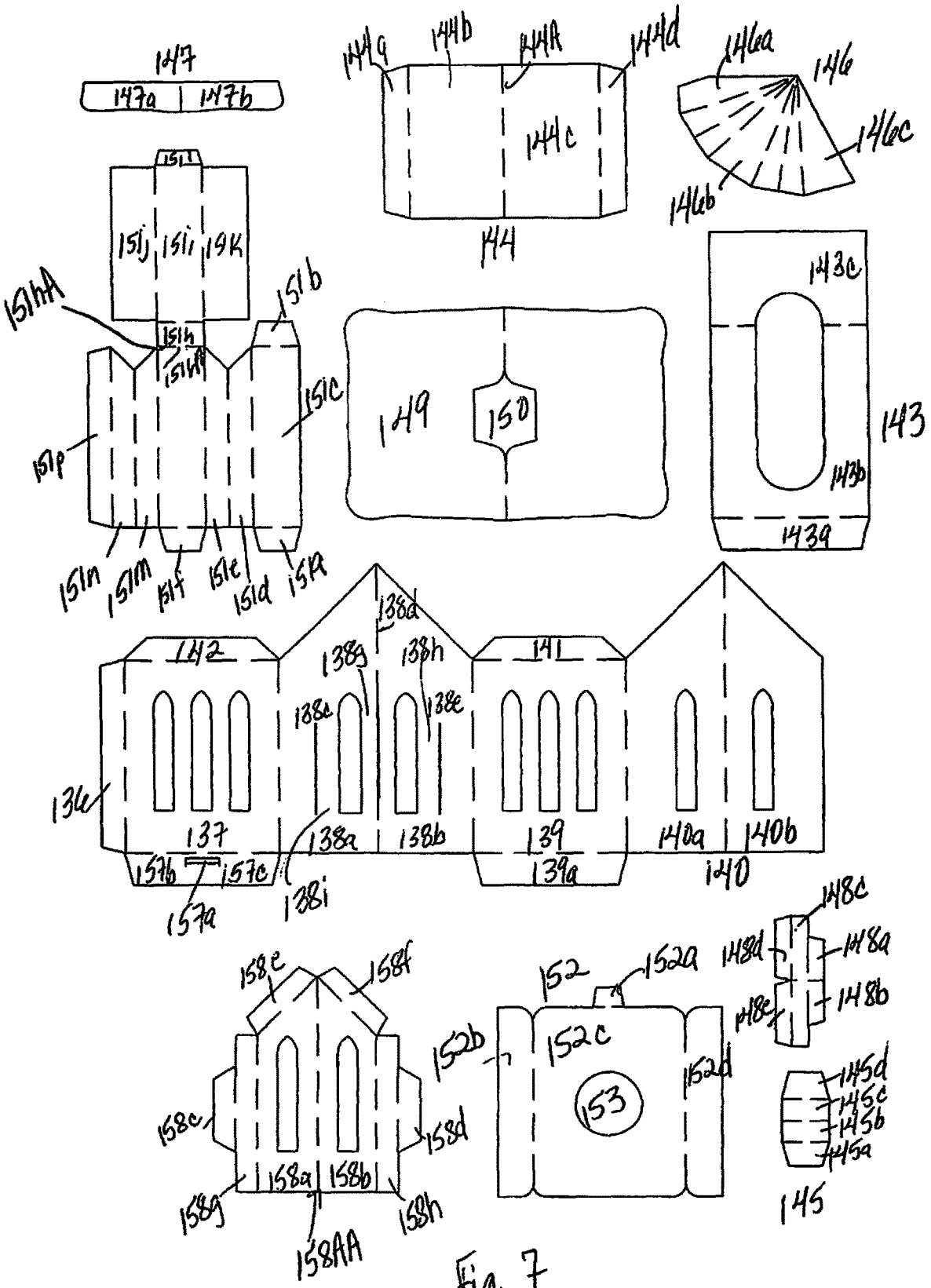
FIG. 7 is an example template showing the design and shape of the various elements associated with a second example embodiment of a four-panel pop up assembly consistent with the principles of the invention in the shape of a church.
Figure 7:
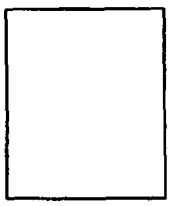
Figure 7:
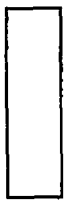
Figure 7:
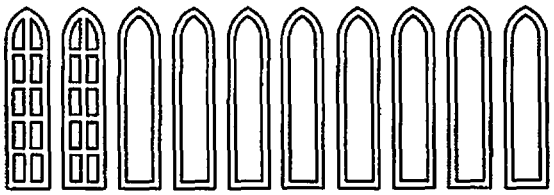

FIG. 7 shows an alternative embodiment of the four-panel paper pop up structure that is consistent with the principles of the invention. The assembly is completed in a similar manner regarding the example embodiment shown in FIG. 6 with the following variation of the internal base being attached to the right side wall panel 139 with the tab slot on the left side wall panel 137. The assembly is completed in a similar manner to the example embodiment shown in FIG. 6 with the following additions: an added front portico 158 with roof 147, and an added tower 151 with steeple 146.

Before assembling the structure, attach two pieces of vellum 55 to inside window openings at back wall panel 140 at openings at 140*a* and 140*b*. Attach additional vellum to inside front windows of portico at window openings at sides 158*a* and 158*b*. Attach remaining vellum 154 to interior surface of the side wall panels left 137 and right 139 at window openings. Attach tab 157*b* and 157*c* to interior surface of the left side wall panel 137 leaving 157*a* and area to the top and bottom of 157*a* void of any adhesive. To assemble the portico to the structure, slip portico support tab 148*a* and 148*b* into front wall panel center slot 138*d*. Split tab and attach 148*a* to inside of 138*g*. Attach 148*b* to inside 138*f*. Insert portico tab 158*d* into front wall panel slot 138*e* and attach to inside 138*h*. At inside center portico score (158AA) attach tabs 148*d* and 148*e* in opposite directions so that 148*d* is attached to interior surface of wall panel 158*a* and 148*e* is attached to interior surface of wall panel 158*b*. Note the tabs will not be attached exactly at the score line. When the front wall panel 138 is folded with the attached portico tab 158*d* in place, the center portico support tabs will align with the front portico in the proper position. This may be 0.031-0.0625 of an inch off center score.

Continue assembling the portico by inserting tab 158*c* into front wall panel slot 138*c* and attaching 158*c* to the interior surface of wall panel 138*i*. Add portico roof 147 by attaching roof tab 147*a* to portico tab 158*e* and roof tab 147*b* to portico tab 158*f*. Assemble the remaining structure in the manner described with regard to FIG. 6 omitting the roof until the tower is assembled.

The tower assembly is completed in the following manner and offers additional dimensionality unlike the prior art with an additional internal support structure found in part 145. To begin, attach tower tab 151*j* to tower tab 151*k*. Attach tower tab 151*l* to underside tower support 145*c*. Fold tower back away and up at score 151*h*A. Attach 145*d* to inside back of 151*g* approximately 1.125 inches from the top of tab 151*f*. Fold tower tab 151*p* and attach to tower support tab 145*a* with the right edge of 151*p* lined up to the center of 145*a*. Fold tower tab 151*c* line up to fold between tower tabs 151*n* and 151*p* attaching 151*c* to remaining half of tower support tab 145*a* and all of 151*p*. Assemble steeple (146) by attaching 146*a* to back side of 146*c* lining up the right side of 146*c* to the score at 146*a*. Line up tower tabs 151*a* and 151*f* to bottom of steeple wall panels 146*b* and 146*c* and attach. To attach tower to center support spreader (144), attach tower tab 151*b* to center top of 144*c* just to right of score 144A and attach tower tab 151*h* to center top of 144*b* just to left of score 144A. To attach roof to structure, place tower 151 through the hole at 150 and attach as described with regard to FIG. 6.

Figure 8:
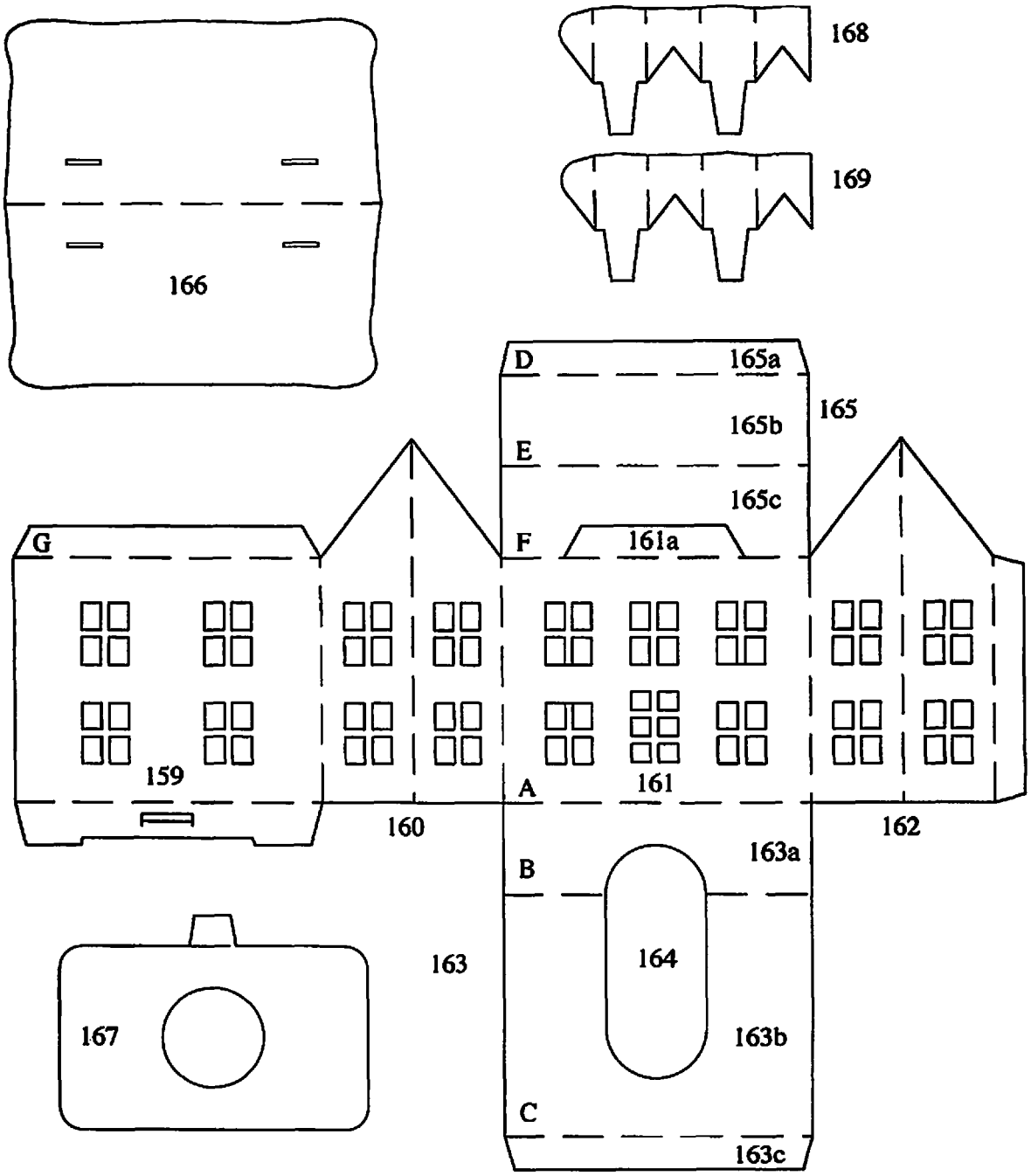
FIG. 8 is an example template showing the design and shape of various elements associated with a third example embodiment of a four-panel paper pop up structure that is consistent with the principles of the invention.

FIG. 8 shows an alternative embodiment of the four-panel paper pop up structure that is consistent with the principles of the invention. The assembly is similar in manner to the example embodiment of FIG. 6 with the following variations: the center internal support structure (163) is an extension of the bottom front wall panel and the spreader (165) is an extension from the top front wall panel. Die cutting the template in this manner eliminates two extra glue tabs while maintaining the integrity of the assembly as described. Note the window panes in this alternative embodiment are cut into the template. This is purely for alternative aesthetics and does not affect application of the internal vellum pieces nor the function of the assembly.

The alternative embodiment is assembled as described with regard to FIG. 6 with the following alterations to the method of assembly. Center internal support 163 is folded at score A back and behind front wall panel 161 whereby tab 163*c* is aligned and attached to spreader 164 just off center of score E on part 164*b*. As in FIG. 6, spreader tab 165*a* is attached just below score G on back wall panel 159. Top front wall tab 161*a* is attached to roof 166 as with regarding to the example embodiment of FIG. 6.

Figure 9:
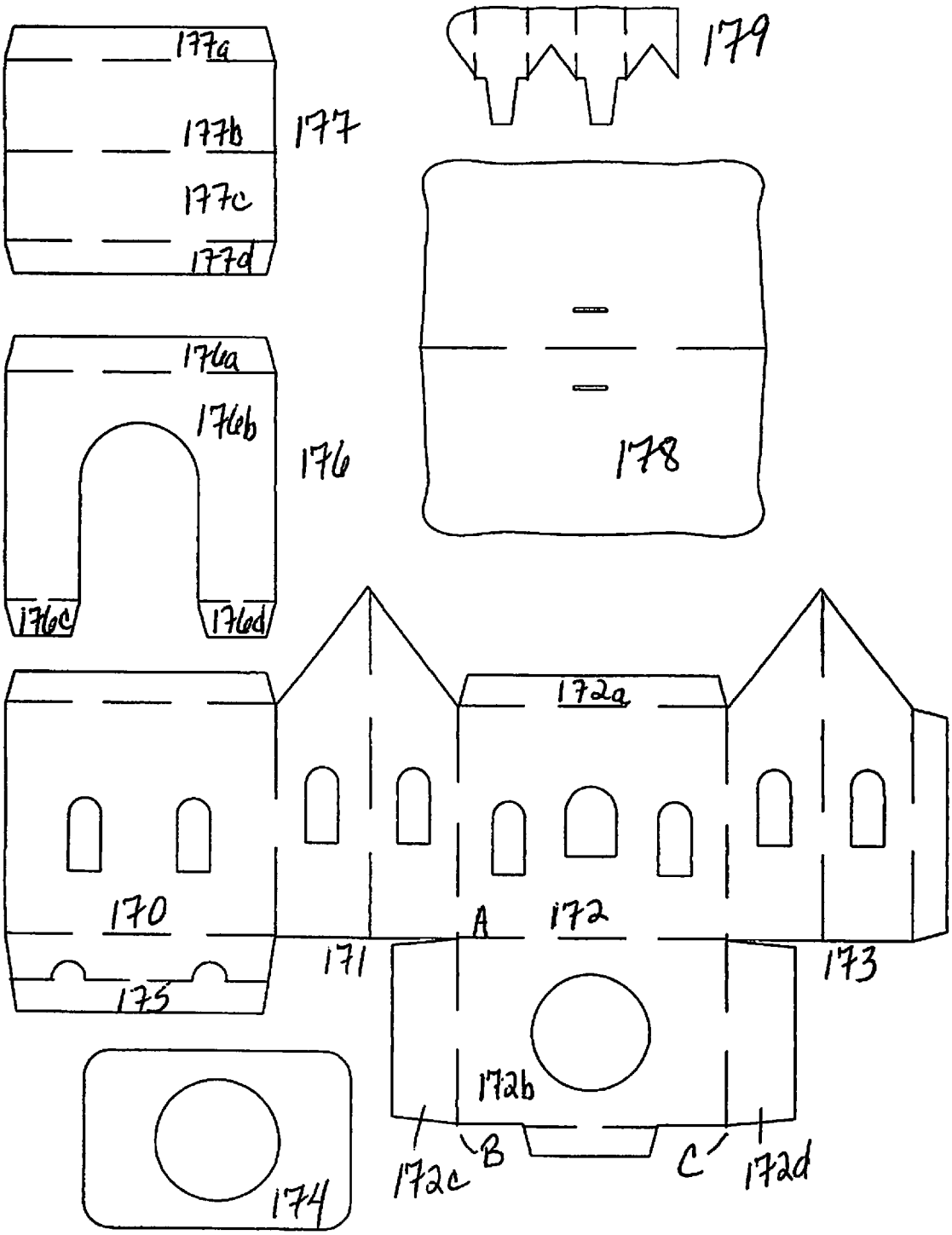
FIG. 9 is an example template showing the design and shape of various elements associated with a fourth example embodiment of a four-panel paper pop up structure that is consistent with the principles of the invention.
Figure 9:
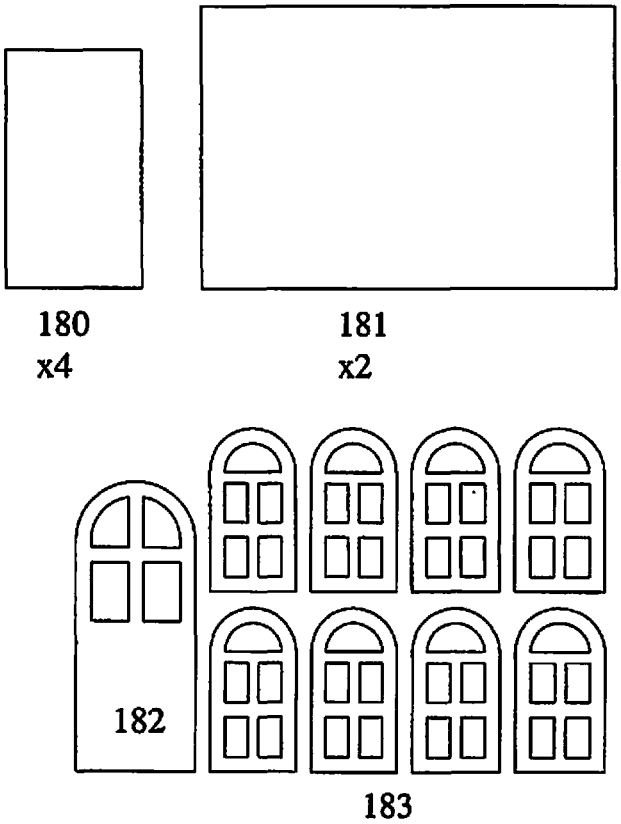

FIG. 9 shows an alternative embodiment of the four-panel paper pop up structure that is consistent with the principles of the invention. The assembly is completed in a similar manner regarding the example embodiment shown in FIG. 6 with the following variation: the base being an extension of front wall panel 172 with added tabs 172*c* and 172*d* and optional base plate 174. The alternative embodiment is assembled as described with regard to FIG. 6 with the following alterations to the method of assembly. The extended front wall panel base 172*b* is folded at score A back and behind front wall panel 172. Tabs 172*c* and 172*d* are folded at scores B and C to back side of extended base 172*b* and attached. The center support structure tabs 176*a* and 176*b* are attached to reference scores at ZZ on the extended base. The additional base plate 174 is optional and attached to base extension 172*b*.

In one embodiment of the present invention, the inventor provides one or more pop-up structures that require much less internal space to effect a manual human or machine initiated pop-up of the structure, the additional space may instead be utilized for other purposes such as for addition of lighting and or sound elements.

Figure 10A:
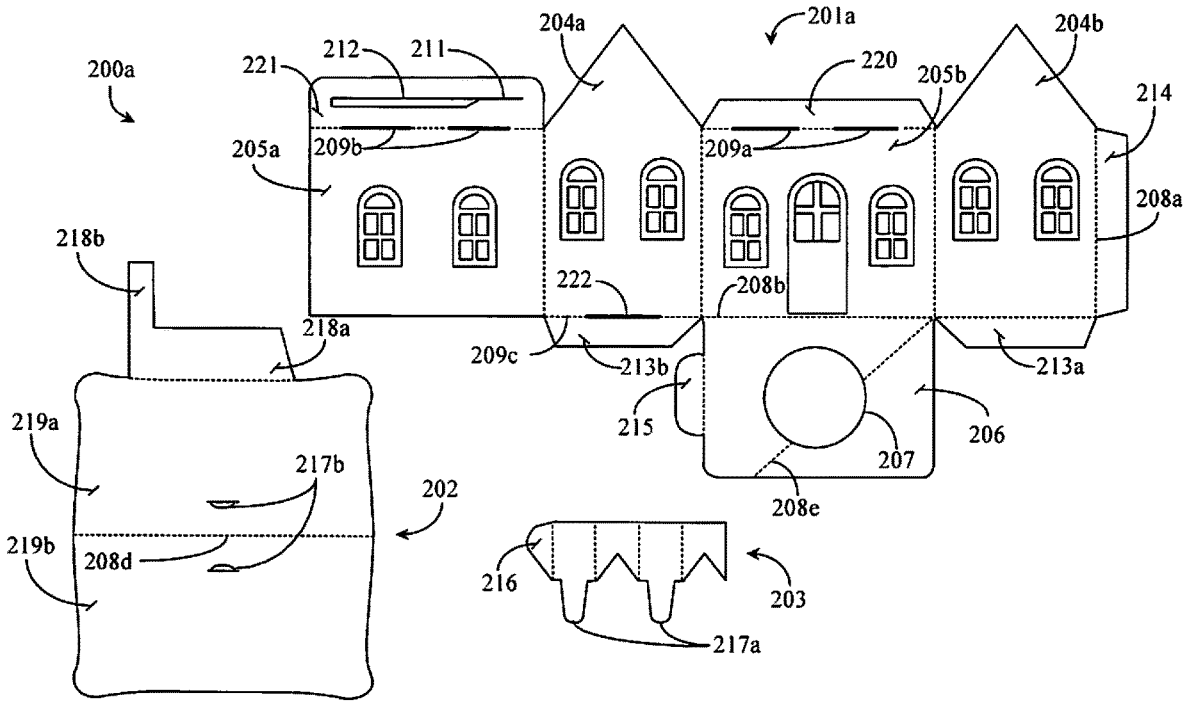
FIG. 10A is an example template showing the design and shape of various elements associated with a fifth example embodiment of a four-panel paper pop up structure where the roof attaches with a tab slot that is consistent with the principles of the invention.
Figure 10B:
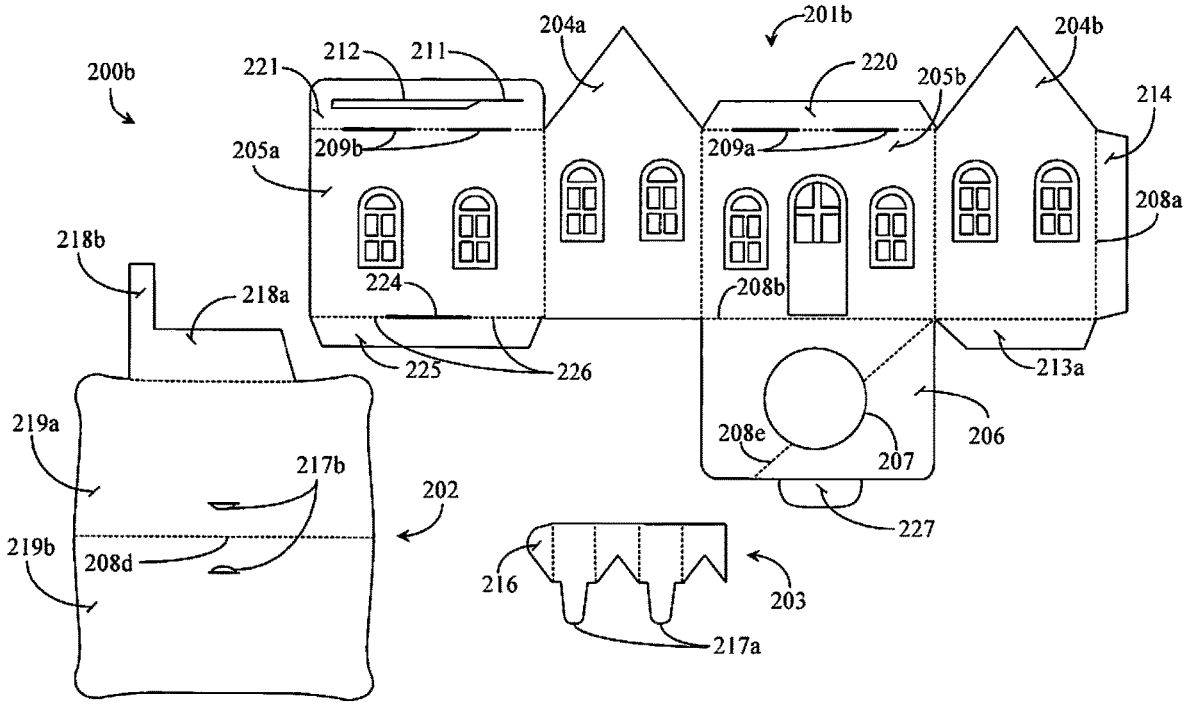
FIG. 10B is an example template showing the design and shape of various elements associated with an example embodiment similar to that shown in FIG. 10A except having an alternate internal base configuration.

FIG. 10A is a flat pre-fold pattern 200*a* of a pop-up structure 201*a* including one or more accessory structures according to an embodiment of the present invention. FIG. 10B is a flat pre-fold pattern 200*b* of a similar pop-up structure 201*b* with an alternative internal base location and configuration. FIG. 10A and FIG. 10B represent a pre-fold pattern 200*a* and 200*b* which is almost identical except for the configuration of the internal base. As further explained below, the internal base 206 of FIG. 10A has a tab 215 which extends from the left side of the base 206 and inserts into corresponding slot 222 located at the intersection of panel 204*a* and tab 213*b*. Internal base 206 of FIG. 10B has a tab 227 which extends from the bottom edge of 206 and inserts into corresponding slot 224 at the intersection between panel 205*a* and tab 225. Both FIG. 10A and FIG. 10B represent pop-up structure patterns which assemble into the form of a house or cottage. The present embodiments of pop-up structures 201*a* and 201*b* are contiguous meaning that all of the components thereof are part of the same material (cardboard, paper, plastic, etc.) In other embodiments, the components may be made of differing materials or a combination of materials generally known in the art for use with pop-up structures. Pop-up structures 201*a* of FIG. 10A and 201*b* of FIG. 10B includes three or more outer structural panels that each represent a side (front, rear, left side, and right side) of the structure type (cottage, church etc.) that the pop-up represents.

Both FIG. 10A and FIG. 10B show outer structural panels including (from left to right in the figure) a rear panel 205*a* formed adjacent to and of the same material as a left side panel 204*a* formed adjacent to and of the same material as a front panel 205*b* formed adjacent to and of the same material as a right side panel 204*b*. In this implementation, each panel is demarcated from at least one adjacent panel via a score or fold line 208(*a-n*) such that the panels may be folded in one direction to form the rectangular pop-up outer structure such as the four walls of a cottage. One will note two slits 209*a* located between score lines at the top edge of 205*a* which it meats 221 and two slits 209*b* located between score lines at the top edge of panel 205*b* where it meets tab 220. These slits are positioned to create a looser fold line at that location and may be of different configuration. The purpose of these slit/score is to allow ease of movement of tabs 221 relative to panel 205*a* and tab 220 relative to panel 205*b* in order to allow the roof structure 202 to slide into a fixed position as later described without difficulty. It is noted herein that there may be fewer or more panels that comprise a pop-up structure than are illustrated herein without departing from the spirit and scope of the present invention. The inventor chooses to represent a rectangular structure (cottage) in this example for familiarity and ease of discussion.

In the patterns represented by FIG. 10A and FIG. 10B, right side panel 204*b* has a glue tab 214 formed adjacent thereto and demarcated from the panel via a score line such as a score line 208*a*. The term "glue tab" is used herein to refer to a tab which may be affixed to or with another portion of the structure using permanent or temporary means. The term "glue tab" is not limited to a tab which is literally glued to another part of the structure and taped with industrial tape though that is a common approach for affixing such tabs as currently known in the art. It is also noted herein that score lines may vary in the amount of material removed along the score thereby affecting the strength of the line itself. In one embodiment a simple fold line may be created as opposed to scoring the material. In another embodiment certain types of score lines may be intentionally defined from one another by the strength of the score, for example the score line for a glue tab may be intentionally stronger than one demarcating one panel from another. Typically, the score depth used for use with cardboard or heavy paper is 2 points (or between 1 and 3 points), but may be lower or higher depending on the type of material used (such as sheet vinyl, plastic or other materials known in the art).

In this implementation and according to the instant view, glue tab 214 may be affixed (whether glued or otherwise affixed through temporary or permanent means known in the art) with and along the vertical edge of panel 205*a* (inside edge when assembled). In order to achieve this each panel is folded approximately ninety degrees (way from viewer perspective) and tab 214 is folded approximately ninety degrees and then glued or otherwise affixed in place to form a rectangular structure. Throughout this description, the term "glued" should also be interpreted as "affixed with, either by temporary or permanent means known in the art". In the embodiments shown in FIG. 10A and FIG. 10B, front panel

205*b* includes a base or base 206. Base 206 is formed of the same material and is demarcated from panel 205*b* by a score line 208*b*. In these embodiments, an additional diagonal score line 208*e* is provided on base panel 206 to enable a post-fold and substantially flat configuration that may be semi-automatically popped out into the cottage structure represented in this example. Base 206 includes an annular opening 207 to allow access to the inside of the pop-up structure for the purposes of adding lighting such as tea light or candle and/or sound implements such as a small speaker. In these examples, annular opening 207 is roughly the same circumference as a standard tea light (or candle) and serves to center the candle within the structure when a tea candle is used to illuminate the interior of the structure.

Looking at FIG. 10A, left side panel 204*a* includes a support tab 213*b*. Tab 213*b* is demarcated from left side panel 204*a* by score line with a slot 222 to receive tab 215 when the internal base 206 is secured. In this example, tab 213*b* serves to provide enough material at the base of 204*a* to allow insert tab 215 to be inserted securely within tab slot 222. Looking at FIG. 10B, a similar tab 227 is located along the bottom edge of base panel 206 and inserts into corresponding slot 224 located between score lines at the bottom edge of panel 205*a* and top edge of tab 225. In FIG. 10A, base panel 206 includes an insert tab 215. Insert tab 215 may be inserted into the tab slot 209*a* of a support tab 213*b*. Support tab 213*a* is not a glue tab and receives no glue or other treatment. It may rest on the inside surface of base panel 206 after insertion of tab 215 immediately after popping out the structure. Similarly, tab 225 of FIG. 10B is an insert tab and receives no glue or other treatment.

The patterns shown in FIG. 10 A and FIG. 10B both utilize a slide locking feature which allows the roof to slide into place and secure when the structure is in the open three dimensional position. Rear panel 205*a* includes a roof interface tab 220 disposed along the top edge of panel 205*a*. Roof interface panel 221 is demarcated from panel 205*a* via cut through slits 209*b* located between score lines which allow panel 221 to fold over from panel 205*a* easily and too tight a configuration when the roof is attached which might impinge the slide locking mechanism. Interface tab 221 includes a catch slot 212 extending horizontally across the tab from a position significantly left of vertical center of the tab. Catch slot 212 is a largely rectangular slot having some material removed to widen the slot for the purpose of accepting a tab inserted loosely there through where the tab is an implement of a roof structure 202 depicted lower left in this view. The end of slot 212 past and significantly right of the vertical center of the tab is extended for a length as a thin tab slot 211 with minimal material removed for roof positioning and position retaining purposes during the pop-up operation as further detailed below.

The patterns shown in FIG. 10A and 10B have roof structures 202 may cut from the same or of a different material than that used to make the wall and base structure of pop up pattern 201. Roof structure 202 includes a front facing roof side 219*b* and a rearward facing roof side 219*a*. In these examples, section 202 may be folded roughly in half over score line 208*d* to form the mentioned roof sides. It is noted herein that the exact structure of the roof is dependent on the structure of the pop-up it is assembled to and may vary in design accordingly. For example, the roof structures of both FIG. 10A and FIG. 10B are gable roof structures but could, in alternative embodiments, be fashioned as a different type of roof structure such as a barn roof, gambrel roof, hip roof or other roof structure with corresponding shaped walls consistent with the spirit of the invention. Roof structure 202 includes a pair of tab insert slots 217*b*, the slots arrayed vertically and equally spaced on either side of the apex (score line) of the roof structure allowing attachment of the chimney tabs 217*a*. In alternative embodiments, other components may be attached to the roof using the same slot/tab approach as that used for the chimney.

Tab insert slots 217*b* are adapted to accept a pair of anchor tabs 217*a* on a chimney structure 203 depicted herein as an accessory the pattern for which is shown to the right of the pattern for the roof structure 202 on FIG. 10. Chimney structure 203 may be rectangular in form and may include three or more sides and a glue tab such as glue tab 216. Roof structure 202 includes a glue tab 218*a* and an insert tab 218*b*. Glue tab 218*a* may be folded over roof section 219*a* and glued to the underside of roof structure 202, the underside being the side up in this view. Insert tab 218*b* is not affixed but left unaffixed and unfolded. Glue tab 220 on front panel 205*b* may be glued to the underside of front portion 219*b* of roof structure 202 under the eve created by the roof edge hanging over the front panel 205*b* of the structure. It is important to note that the top edges of both panels 205*a* and 205 have score line and slits, 209*b* and 209 respectively, which allow tabs 221 and 220 to fold easily along the top edges of panels 205*a* and 205*b* allowing a roof attachment with enough play to prevent the slit locking mechanism where tab 218*b* of 202 slides along opening 212 and into slit 211 to function easily and without catching.

In general assembly of a post fold pop-up assembly, a user may fold pattern 201 along the score lines in a same folding direction for each panel to form the rectangular pop-up outer structure without the roof or chimney attached. In this operation the glue tabs are glued to (or otherwise affixed with using alternative permanent or temporary means) their respective positions and the insert tab inserted to close the rectangular structure and secure the base or base. A user may then prepare roof structure 202 for assembly by folding and gluing glue tab 218*a* down to the underside of the roof leaving tab 218*b* free. A user may insert tab 218*b* into and through tab insert slot 212. Once tab 218*b* is inserted into catch slot 212 it may be slid along the catch slot until it slips into tab slot 211 where a tighter frictional fit exists lending to retaining of the roof structure in a position over the rectangular structure in a fashion that also tends to retain the roof structure in position and discouraging slip back. Once retained in position over the rectangular structure, the roof structure 202 holds the top of the structure in an open (non-collapsed) position.

At this point chimney 203 may be prepared by folding the chimney panels each in the same direction at an approximately ninety degree fold to form the chimney with downward facing insert tabs 217*a*. Glue tab 216 may be glued to (or otherwise affixed with) the inside surface of the chimney pattern to hold the rectangular structure. Chimney 203 may be placed upon the roof structure by inserting tabs 217*a* into tab slots 217*b*. Cutout shapes may be a decorative and or a functional structural enhancement such as the windows and door depicted on pattern 201. Any number of other features such as awnings, pop-out windows, and other design elements consistent with the overall design and character of the pop-up structure might also be provided. It should also be noted that the embodiments shown in FIG. 10A and FIG. 10B provide for a secure attachment at the roof line which effective allows the structure to be moved into an open position and secured without requiring the use of an internal base. While in a preferred embodiment, use of the internal base 206 is helpful to making sure the structure stays open, the present inventors have determined that these particular embodiments shown in FIG. 10A and 10B are capable of being adequately secured and functioning without any internal base.

Figure 11:
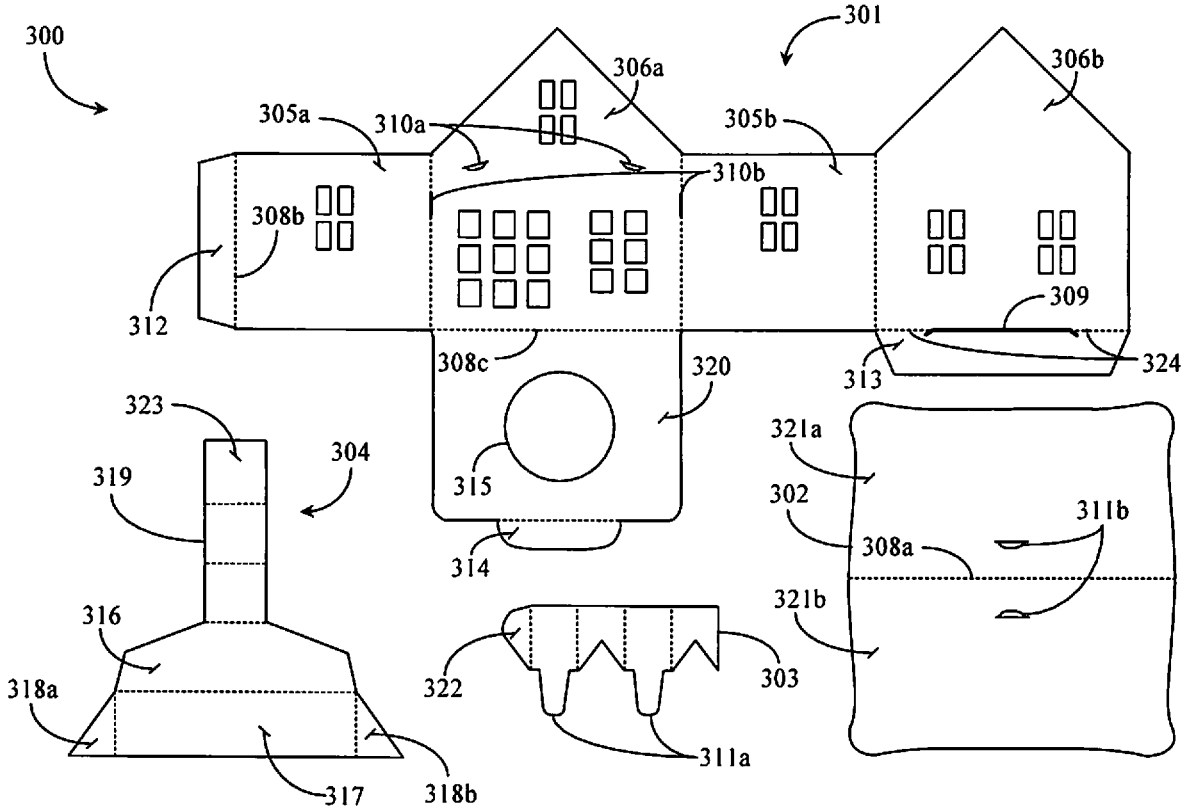
FIG. 11 is an example template showing the design and shape of various elements associated with a sixth example embodiment of a four-panel paper pop up structure where the roof attaches with a swivel interface that is consistent with the principles of the invention.

FIG. 11 is a flat pre-fold pattern 300 of a pop-up structure 301 including one or more accessory structures according to another embodiment of the present invention. In this embodiment a roof interface mechanism is provided that is minimal in the amount of space required to implement it and that functions to swivel a roof section from a post-fold substantially flat position to an open three dimensional position on top of the structure including a capability of retaining the roof section in place and positioned down upon or near the walls of the structure.

In this particular configuration, pop-up structure 301 includes a front wall 306*a*, a rear wall 306*b*, a left side wall 305*a*, and a right side wall 305*b*. Panels 305*a* through 306*b* are each demarcated from at least one adjacent panel of the same contiguous material by score or fold lines 308(*a-n*). A roof section 302 is provided as a separate pattern having at least two sides including a roof side 321*a* and a roof side 321*b*. The apex of roof section 302 is defined in this configuration by a score line 308*a*. In one embodiment, pop-up structure 301 includes other or added tab slots such as tab slots 310 in order to accommodate certain pop-up accessories like awnings, roof implements and other structural enhancements that may be decorative and or otherwise functional implements.

Left side panel 305*a* includes a glue tab 312 analogous at least in function to glue tab 214 of FIG. 10A and FIG. 10B described previously. In this implementation, glue tab 312 is disposed vertically at the left edge of panel 305*a*. Glue tab 312 is demarcated from panel 305*a* via a score line 308*b*. Glue tab 312 may be glued to the unassigned inside edge of rear panel 306*b* when preparing a post-fold pop-up assembly. Front panel 306*a* includes an internal base-panel 320 demarcated from panel 306*a* via a score line 308*c*. It is noted herein that pattern 301 is cut from a same piece of material. However, this is not specifically required to practice the invention as panels may be separate pieces that may be fastened to one another such that they fold at the demarcation boundaries.

Front panel 306*a* includes an internal base panel 320 disposed at and along the bottom edge of panel 306*a*. Base panel 320 is described as "internal" because it sits between the four wall panels of the structure when open and does not extend beyond those walls. However, in alternative embodiments, base panel 320 could extend beyond one or more walls and, conceivably, tab 314 could extend from the field (and not the edge) of base 320. In this embodiment, base panel 320 is demarcated from front panel 306*a* via a score line 308. Base panel 320 includes an opening 315 that is analogous in size and function to opening 207 of FIG. 10 described further above. Rear panel 306*b* includes a support tab 313 disposed horizontally at the lower edge of the panel. Support tab 313 includes a tab insert slot 309 adapted to catch and accept insert tab 314 on base panel 320. Each panel in this example may be folded ninety degrees in a same direction to form the rectangular structure. In both of the embodiments described thus far the base panels may be opened automatically from their pop-up structure position by manually collapsing the structure in one direction at the score lines separating the panels from one another.

A chimney pattern 303 is provided in this example and is analogous to chimney pattern 203 of FIG. 10A and FIG. 10B described further above. In one embodiment chimney 303 may be of an alternative design. Chimney 303 includes a glue tab 322 and a pair of insert tabs 311*a*. Chimney 303 may be assembled in the same way described above regarding chimney 203. Roof section 302 includes a pair of tab insert slots 311*b* adapted to accept insert tabs 311*a* of chimney 303. In this configuration, horizontal insert slots 310*a* and vertical insert slots 310*b* are available for insertion of awnings or other components which may extend from the side panel 306*a* in keeping with the aesthetic theme and style of the structure. In alternative embodiments, the insertion slots can be located on other side panels as necessary to receive insertion tabs of such components such as the insertion tabs exhibited as 311*a* for the chimney component 303.

In this particular configuration, a roof interface mechanism 304 is provided to attach roof section 302 to an upper portion of walls 306*a* and 306*b* which in this case form gables. As with the embodiment shown and described for FIG. 10A and 10B, an alternative embodiment could have differing roof structures (gambel, hip etc.) with corresponding walls. Pattern 304 includes a glue section 316 that may be glued down (or, again, affixed with either temporarily or permanently) onto the inside surface of roof section 302 in a position on one roof side adjacent to the apex line 308*a* of the roof. Roof interface 304 includes a support panel 317. Support panel 317 forms a vertically hanging structure that serves as a roof attachment mechanism that folds flat with the roof and positions the roof on top of the structure during pop-up operation.

Support panel 317 includes opposing glue tabs 318*a* and 318*b* disposed at opposite ends of the tab and that are demarcated from panel 317 via score lines. Glue tabs 318*a* and 318*b* are triangular shaped roughly conforming to the roof angle. Glue tabs 318*a* and 318*b* may be folded approximately 90 degrees in opposing directions and glued to the respective wall panels at the apex at the top of each wall panel wherein the score lines of the tabs present orthogonally to the score line 308*a* of roof section 302.

Mechanism 304 includes a neck portion 319 having three panels separated by score lines. The last of these panels at the end of neck portion 319 is a glue panel 323. Glue panel 323 may be glued on (or otherwise affixed with) the underside of roof section 302 on the opposing roof side supporting glue section 316 after neck portion 319 is folded at the score lines in a same direction around support panel 317 that is intended to hang down vertically from the top of the roof. In this configuration roof section 302 may be attached to pop-up structure 301 using roof interface mechanism 304 wherein the roof section may fold flat in a post-fold presentation and then may be caused to turn or swivel into place during the pop-up procedure (i.e. movement from a closed flat position to an open three dimensional position).

Referring now to FIGS. 10A, 10B and 11, roof interface mechanism (tab 221) aided by tab 218*a* with extension tab 218*b* of FIG. 10A and FIG. 10B provide a means to slide a roof section such as roof section 202 into place on top of pop-up structure 201 whereas roof interface mechanism 304 of FIG. 11 provides a means to swivel a roof section such as roof section 302 into place on top of pop-up structure 301. In the first instance illustrated by FIG. 10A and FIG. 10B, a user may be required to insert extension tab 218*b* into slot 212 before pop-up implementation. In the second instance illustrated by FIG. 11 no action is required prior to pop-up aside from properly attaching the mechanism to the structure. In both instances, the pop-up structure may be presented in an unobstructed manner as a substantially flat post-fold presentation that is described in more detail later in this specification.

Figure 12:
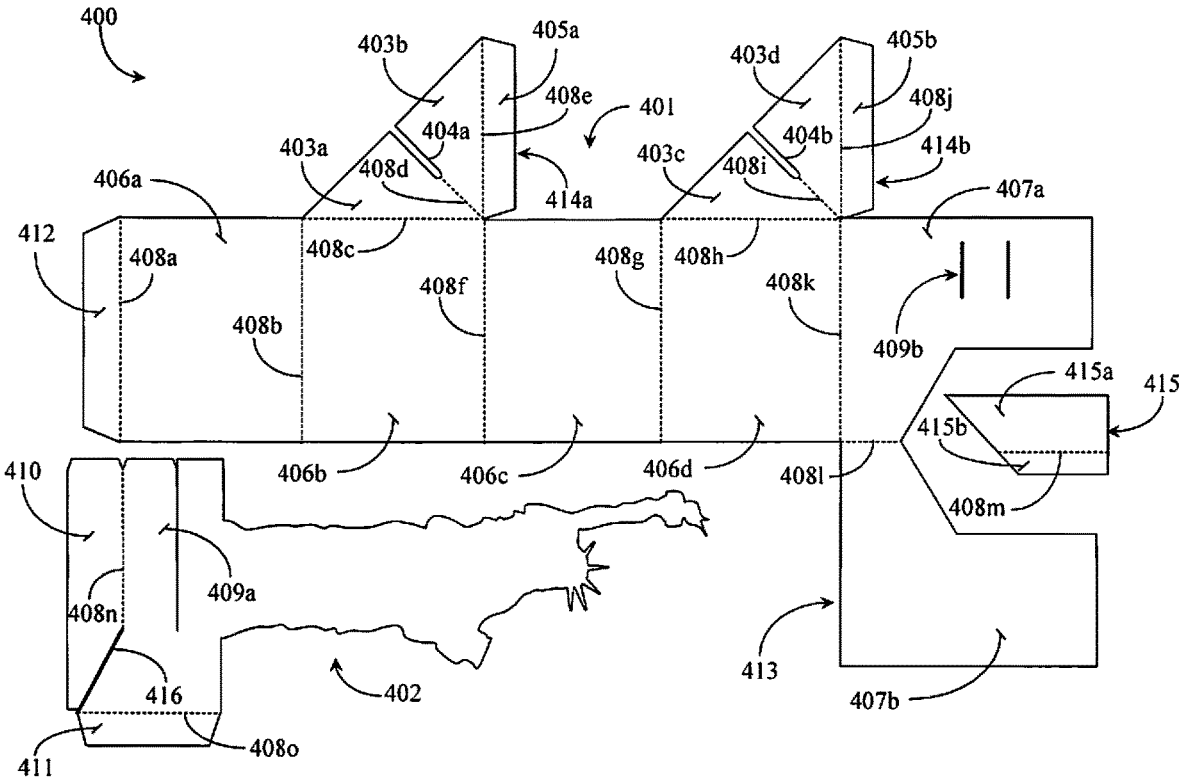
FIG. 12 is an example template showing the design and shape of various elements associated with an embodiment of a paper pop up structure that is consistent with the principles of the invention.

FIG. 12 is a flat pre-fold pattern 400 of a pop-up structure 401 according to yet another embodiment of the present invention. It is duly noted and repeated herein that it is not required that the pop-up structure represent a building or cottage or house in order to practice the present invention. A pop-up structure of the present invention may be virtually any type and configuration of a three dimensional enclosure that may serve as a decorative base or station for display of an accessory item.

In this particular configuration pop-up structure pattern 401 may be formed into a substantially flat post-fold pop-up structure that may be urged manually or automatically in some embodiments to pop-out and position and retain an accessory cut out such as cut-out 402. In this example, cut out 402 represents the well-known Statue of Liberty. Of course, one with skill in the art of pop-up structures that may be folded flat from a pop-up position will recognize that element 402 may represent any type of entity or icon or other decoration without departing from the spirit and scope of the present invention. Furthermore, slogans, phrases, dates, and other indicia may be provided by cutting out the patterns for such indicia in the panels making up the structure.

Pop-up structure 401 includes four side panels depicted herein as a panel 406*a*, a panel 406*b*, a panel 406*c*, and a panel 406*d*. Side panels 406*a* through 406*d* may be demarcated from one another at score lines 408. Pop-up structure pattern 401 includes a glue tab 412 for closing off the rectangular structure of the pop-up outer walls and may be affixed with an inside surface of panel 406*d*. An accessory mounting component 413 is provided at the end of pattern 401 opposite glue tab 412 and adjacent to structural panel 406*d*. Interface component 413 is adapted to house accessory 402 in this example. Interface component 413 is demarcated from adjacent panel 406*d* via a score line 408*k*.

Accessory interface component 413 comprises two accessory interfacing tabs 407*a* and 407*b* demarcated from each other via score line 408*l*. The overall length of interfacing component 413 from the adjacent score line 408*l* to the far edge of the pattern is roughly the same length as the diagonal length from corner to opposite corner of the pop-up structure assembled and popped out. Component 413 serves as a folded sleeve housing for accessory 402. Accessory 402 may be installed to accessory interface component 413 via a sliding interface composing of a pair of symmetrically aligned tab insert slots 409*b* and an insert tab 409*a* strategically provided on accessory 402.

Insert tab 409*a* has a width dimension just smaller than the height dimension of the aligned pair of tab slots 409*b* such that accessory 402 may be attached to pop-up structure 401 and housed in an upright manner by component 413. Accessory 402 further includes a glue tab 410 situated adjacent to insert tab 409*a* and of similar length and width so as to be folded over and glued down to (or otherwise affixed with) insert tab 409*a* to add thickness to the insert for more contact friction resistance and to reinforce the stiffness of the insert tab. In the present embodiment 416 represents a slit that allows 410 to be folded over onto 409*a*. In alternative embodiments, 416 may be a horizontal slit extending from the bottom end (as shown) of 408*n* and extending at 90 degrees toward the outside edge of 410.

Accessory 402 includes a glue tab 411 demarcated from the rest of the accessory by a score line. Glue tab 411 serves to anchor accessory 402 to one inside corner of the pop-up structure once assembled into a post fold, but substantially flat, presentation that may be subsequently popped out to form the pop-out structure. Interface component 413 may be anchored at the opposite corner of the structure via glue tab 412. In one embodiment a separate patch tab 415 is provided and includes a horizontal score line 408*m* separating the top portion tab 415*a* from the bottom portion tab 415*b*. Score line 408*m* is noted in dotted lines. Tab portion 415*a* is the top portion and tab portion 415*b* is the bottom portion as divided by the score line 408*m*. Patch tab 415 may be used to close off the bottom portion of the folded interface component 413 by gluing tab 415*a* it in a folded position over the bottom edge of the interface component in a folded state.

Pop-up structure pattern 401 includes accessory positioning tabs 414*a* and 414*b* contiguously part of panels 406*b* and 406*d* respectively. The positioning tabs are demarcated from the respective panels via score lines 408*c* and 408*h* as depicted in FIG. 12. Each positioning tab further includes glue tabs 405*a* and 405*b* and accessory relief slots 404*a* and 404*b*. Accessory relief slots 404*a* and 404*b* extend diagonally from the angled edge of each tab toward the substantially 90-degree corner of each tab. Each positioning mechanism comprises two half-tabs such as half-tabs 403*a* and 403*b* of positioning mechanism 414*a* or half tabs 403*c* and 403*d* of positioning mechanism 414*b*.

Figure 15:
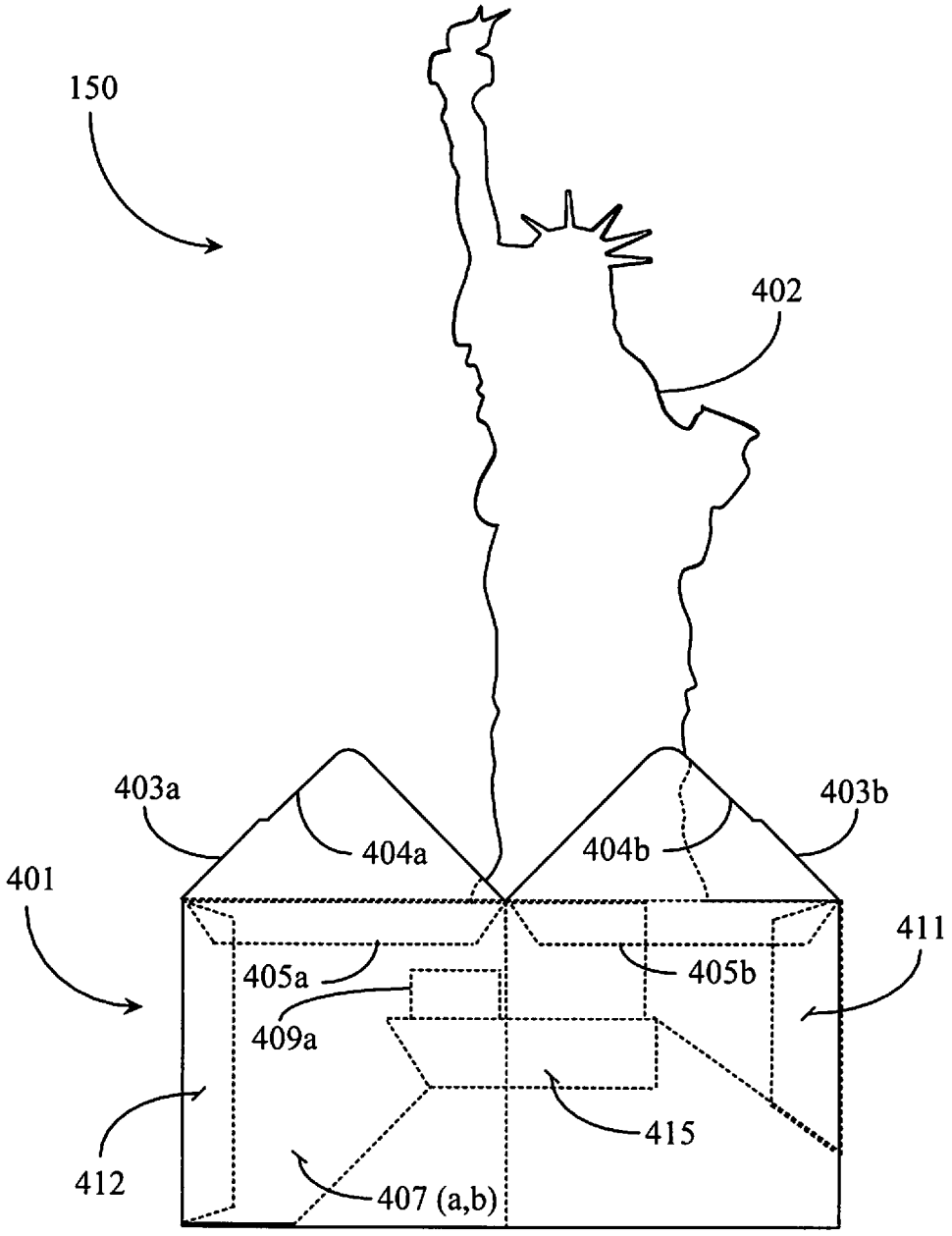
FIG. 15 is an example of a flat post-fold pattern 150 of the pop-up structure of FIG. 12.

Glue tab 405*a* of accessory interface tab 414*a* and glue tab 405*b* of accessory interface 414*b* are adapted to be glued down onto the inside upper edges of the panels 406*c* and 406*a* when assembling into a post fold presentation. In this example, the bottom of the pop-up structure is completely open. Pattern 400 including accessory 402 may be assembled and folded into a post-fold pop-up presentation that is described later in this specification. In this configuration, the accessory interfacing component 413 comprising 407*a* and 407*b* is which are over on one another internally and becomes the structure that holds accessory 402 which together occupy a substantially vertical plane extending diagonally between opposing corners of the rectangular profile where the rectangular profile is a square profile having equal sides. As folded and shown in FIG. 15, 407*b* is not visible because it is sitting behind 407*a* that is shown in FIG. 15.

Figure 13:
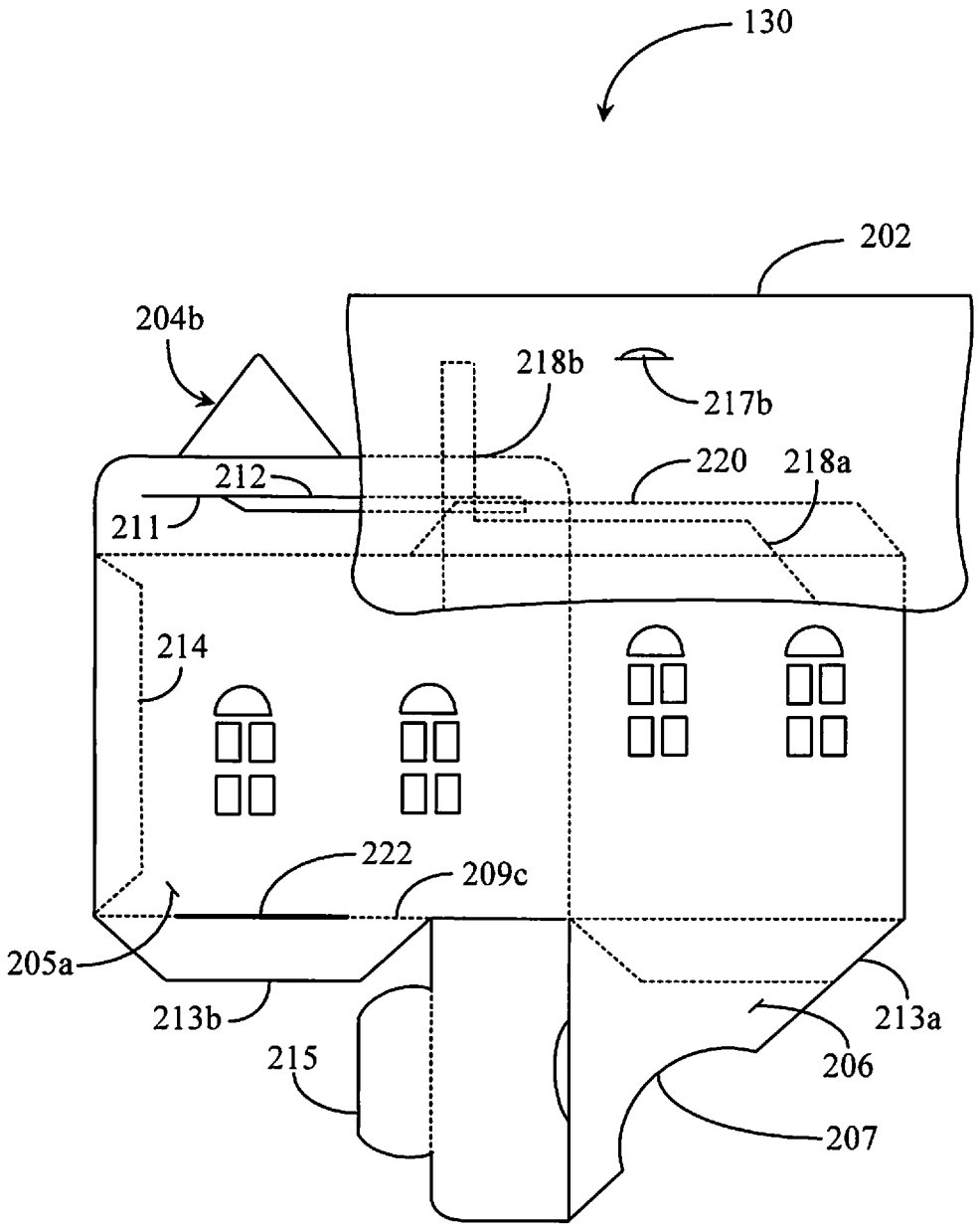
FIG. 13 is an example of a flat post-fold pattern of the pop-up structure of FIG. 10.

FIG. 13 is a flat post-fold pattern 130 of the pop-up structure of FIG. 10. Pattern 130 represents a one-sided view of a post-fold and collapsed state of pop-up structure pattern 200 depicted in FIG. 10 with glue tabs affixed and the roof section attached and ready to pop-out. In this embodiment, roof structure 202 is folded in half during the collapsed state. In this view the forward side of roof structure 202 is held to the far side of the collapsed structure via glue tab 220 depicted in broken line boundary. Glue tab 218*a* is glued to the inside surface of the rearward roof side leaving insert tab 218*b* to be inserted into capture slot 212. Glue strip 214 and glue strip 213*a* are depicted in their respective glued positions on the inside surfaces of base 206 and panel 205*a*. It should again be noted that in alternative embodiments the glue tabs may be temporarily or permanently affixed with rather than glued to their corresponding components using means known in the art. Base 206 is folded over the diagonal score line. Insert tab 215 is not engaged into the tab slot 222 located along the score line 209*c* of support tab 213*b*. This interface is manually connected when the pop-up operation is complete to close off the bottom save for opening 207.

In general operation to effect a pop-up structure from a collapsed state, a user may urge the structural corner at left in this view against the opposite corner to cause the structure to pop out. During the pop out motion insert tab 218*b* slides toward and into catch slot 211 which provides a narrower slit to anchor the insert tab 218*b* in open position. At this point the pop-out structure is formed and insert tab 215 may be inserted into the appropriate tab slot on tab 213*b* to close the structure. Insert tab 218*b* functions to urge the otherwise non-attached side of the roof down against the structural side walls and slot 211 adds contact friction to help retain the roof into its position.

A user may reverse the direction of force at the left corner in this view in order to collapse the pop-out structure back into the collapsed state depicted herein. This action causes tab insert 215 to disengage from the tab slot of support tab 213*b* and the structure collapses back into the post-fold state depicted here. Of course the user may open and close the structure using forces from a variety of directions (for example pulling open some corners rather than pushing in against them) once the structure has begun to fold from its closed flat position to its open three dimensional position.

Figure 14:
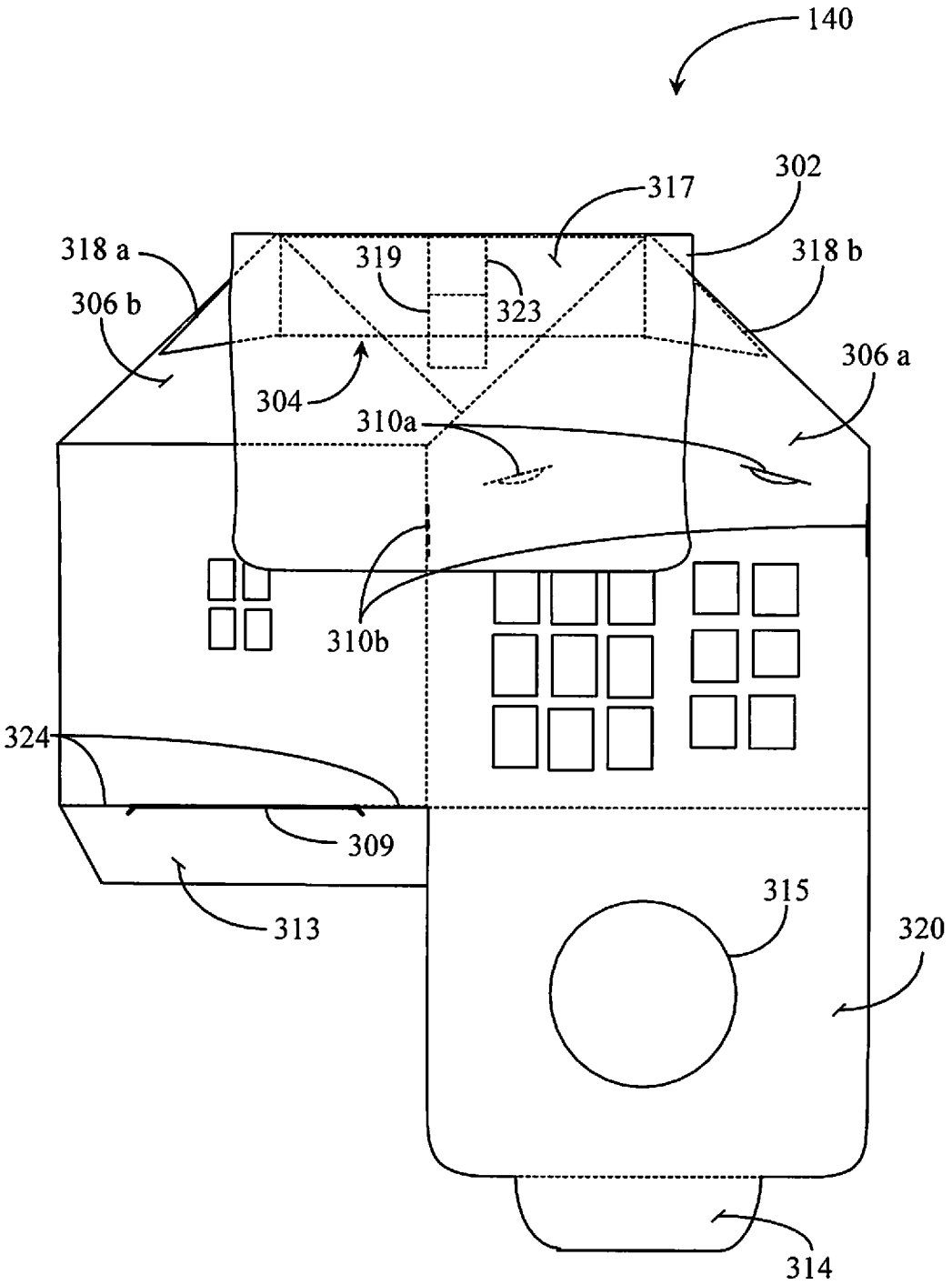
FIG. 14 is an example of a flat post-fold pattern 140 of the pop-up structure pattern 300 of FIG. 11.

FIG. 14 is a flat post-fold pattern 140 of the pop-up structure pattern 300 of FIG. 11. In this view roof structure 302 is folded over and attached to roof interface component 304 depicted in FIG. 11. In this view, the glue tab or end 323 is glued down to the inside surface of the forward facing roof side of roof structure 302. Glue section 316 (not illustrated) is glued down to or otherwise affixed with the inside surface of the rearward facing roof side. Support panel 317 is glued in place via glue tabs 318*a* and 318*b* to the inside surfaces of the opposing front and rear panels 306*a* and 306*b* respectively. Support panel 317 hangs beneath the roof apex vertically along and parallel to the roof apex line (score line) presented horizontally in the collapsed view depicted herein.

In this collapsed view (post fold/glue state), base 320 is not attached to panel 306*b* via insertion of the tab into tab slot 309 of support tab 313. Tab slot 309 is located between 324 as shown. This action may be performed manually by the user after pop-out to close the base to the structure. In general operation, a user may apply force from the far left corner toward the opposing corner held stationary to expand the structure out. In the process of expanding the structure, roof section 302 automatically swivels into place over the structure supported by panel 317. The user may then insert tab 314 into tab slot 309 on support tab 313, which folds in to close the base to the structure.

Roof section 302 is furthermore urged downward against the top edges of the structure side panels by the tension created by the roof interface mechanism, specifically extension 319 folded about support panel 317 and glued to (or otherwise affixed with) the underside of the roof via glue section 316 and glue tab or end 323. The user may reverse direction of the force to the left corner of the pop-up to collapse the structure back into the post fold pattern depicted herein.

FIG. 15 is a flat post-fold pattern 150 of the pop-up structure of FIG. 12. In this view, accessory interface component 413 comprising support tabs 407*a* and 407*b* (not shown) may be folded over and secured inside the pop-out structure in a folded state via glue tab 412. Accessory 402 may be installed in-between the folded interface component via insertion of insert tab 409*a* from right to left through tab slots 409*b* such as through one of the tab slots from the rear and back through the adjacent tab slot to the rear. A broken boundary labeled 409*a* represents the insert tab inserted through the paired slots 409*b*. Accessory 402 may include separate patch tab 415 provided in one embodiment to close off the bottom edge of the accessory housing mechanism at the lower or bottom edge.

Accessory 402 is secured to the far right corner of the outer panel structure in this view via glue tab 411. Half-tabs 403*b* and 403*d* are folded over and secured to the panel structure (inside walls not visible) via glue tabs 405*a* and 405*b*. In general operation, a user may urge the far left edge in this view toward the opposite corner to expand the outer wall structure. This action causes accessory 402 held within interface component (sleeve) 413 to slide into a center position for display. Positioning tabs 414*a* and 414*b* (not shown in FIG. 15 but depicted in FIG. 12) act to capture and retain accessory 402 at the center position with minimal lean due to contact support via accessory relief slots 404*a* and 404*b*. A user may reverse the direction of force to collapse the pop-up back into the post fold state depicted herein. In this case, no assembly is required of the user after expansion of pattern 150 into the pop-out form, which has a square profile in this example. Accessory 402 is permanently installed within the interface component in this case. In a variation of this embodiment as well as other embodiments described in the various Figures above, temporary attachment means such as providing hook and loop connectivity may be implemented to affix the glue tabs rather utilizing permanently glued on tabs. In still other variation, the type of glue used to affix glue tabs to corresponding surfaces may allow temporary attachment and enable the pattern to be disassembled wherein one accessory might be swapped out for another. In other variations, other materials may be inserted between the glue tabs and their corresponding surfaces to enhance connectivity or otherwise allow materials used to form glue tabs to be affixed to different materials used on the corresponding attachment surfaces.

It will be apparent to one with skill in the art that the pop-out structures of the present invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

The assemblies described herein, as in FIGS. 1-15, may be made of a variety and combination of materials typically suitable for making pop up structures such as paper cardstock, light sheet plastic, Vellum (for transparent portions such as windows), vinyl and other materials known in the industry. In a preferred embodiment, structural elements of the inventive assembly are made of paper cardstock due to its natural rigidity and ability to fold. The stiffness of the cardstock aids in keeping the shape of a structure in its open (i.e. three-dimensional) second position while still allowing the structure to fold into the closed (i.e. flat) first position. For example, the paper cardstock used for the four wall panels for the depicted example embodiments preferably ranges in caliper from 10 to 14 points. Since the base has a center cut-out circle measuring in diameter of 1.5625 inches, allowing for an external light source to be used, and since a minimum caliper is needed on the base to be able to pull down and hold the internal support structure without bending or breaking the material during this action, the preferred caliper of the material used on the base is 0.024 inches or 24 points. While the several depicted example embodiments involve a square or rectangular three-dimensional structure (such as a house or church design), other embodiments may contain three-dimensional structures having more or fewer panels, different sizes, and/or different shapes. The embodiment of an alternative assembly in the shape of an angel, for example, may have only two exterior wall panels whereas the church and house shaped assemblies have four. A two or three dimensional tree design may have three-dimensional pop up ornaments attached thereto etc.

As the size of the structure increases, so shall the caliper of material in order to accommodate the structural requirements associated with keeping a larger (more heavily weighted) assembly.

The decorative overlays, such as windows, can be comprised of many types of materials since they are decorative and generally do not affect the structural integrity of the assembly. However, decorative overlay materials should be somewhat flat in appearance so as not to hinder the first folded flat position. Again, materials such as Vellum which provide translucence may be more appropriate than cardstock or paper in certain areas such as window areas depending on design. The thickness of the cardstock at the base allows for built-in lighting to be manufactured directly into the base with a battery power source and on and off switch.

The inventive assembly and method described herein offers several advantages over traditional three-dimensional pop up assemblies. The inventive assembly encompasses a method of opening and closing in a way that is counter to traditional pop ups. This allows the base to fold into the pop up making it a complete and independent self-contained unit maintaining the integrity of its intended size in the folded flat and open positions without its base extending externally from the walls or any protruding mechanisms.

Because the aesthetics of the inventive assembly can be viewed in the fold flat position, it can be displayed individually in a flat position or as a set in a stationery-like box. Further, the inventive design eliminates the need for significant retail space for display or storage of the invention.

The internal base and center support design makes the invention compact in size allowing for easy storage by the end user. The internal base and center support design which eliminates the need for an extended base or protrusion makes it easier to mail as a gift or promotional item. The elimination of the extended base and/or protrusion means that fewer materials are used in the fabrication and thus the inventive assembly is less expensive to make than prior art assemblies.

Figure 16A:
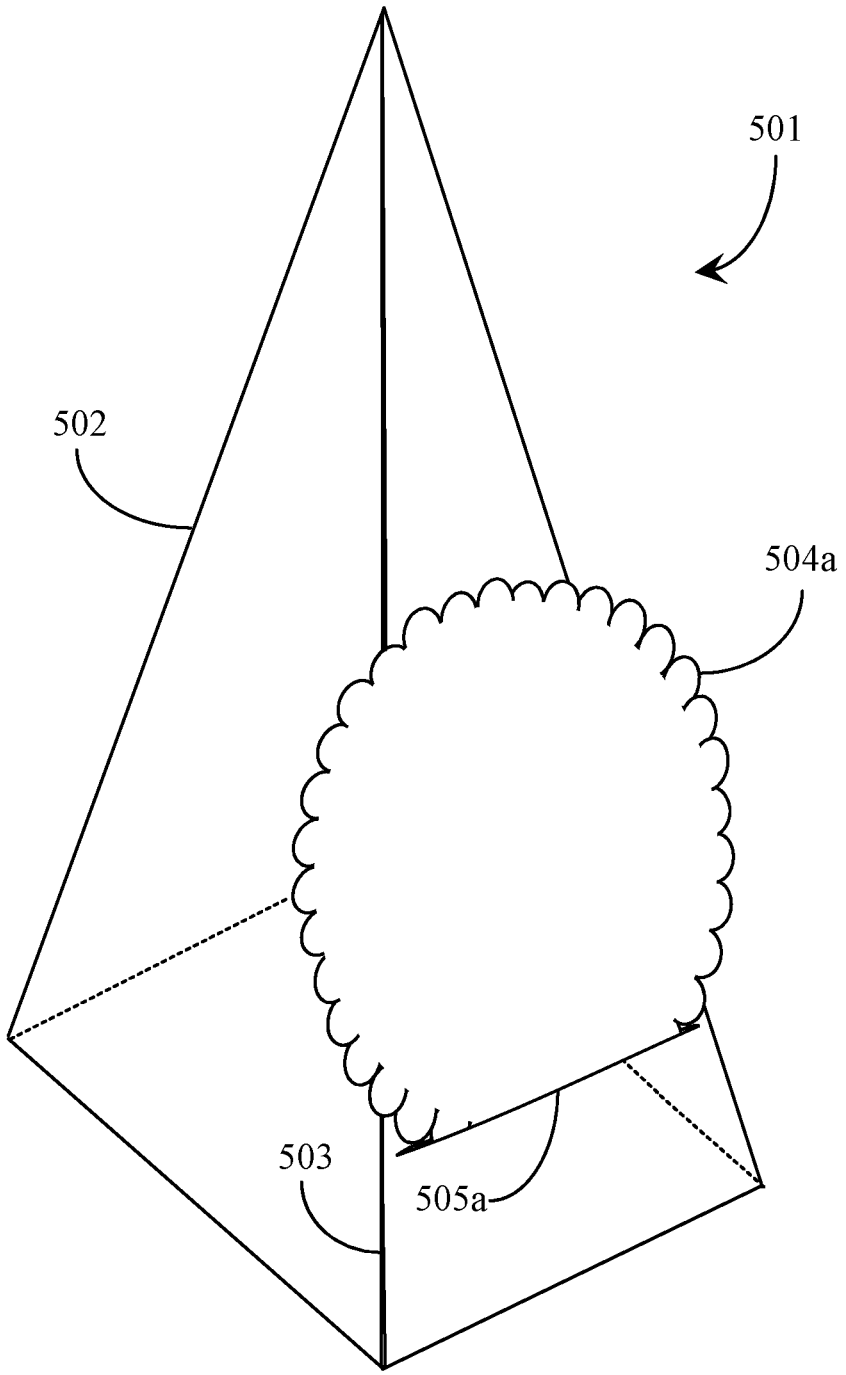
FIG. 16A is a perspective view of a pop up pyramid embodiment of the present invention.
Figure 16B:
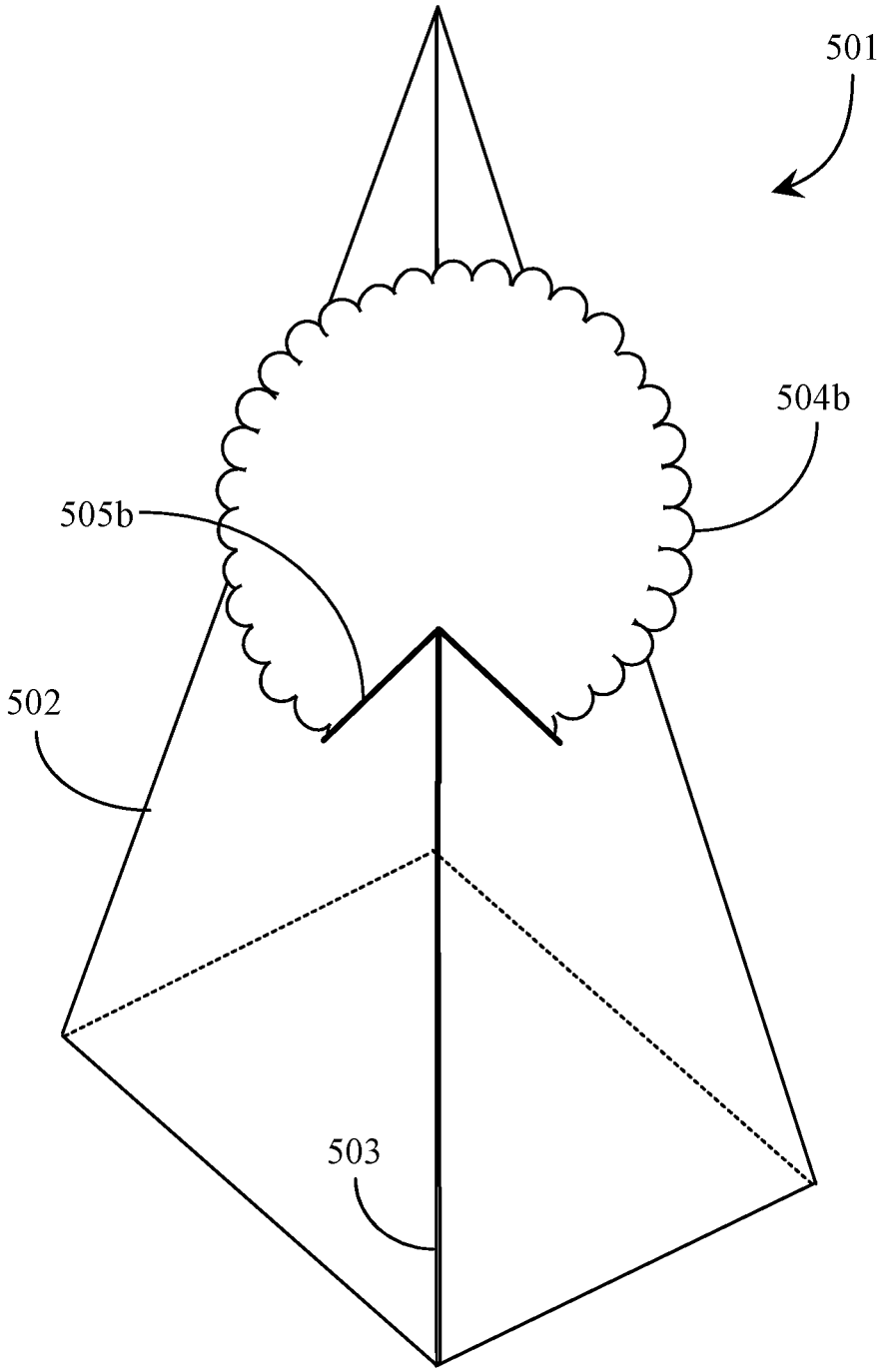
FIG. 16B is a perspective view of a variation of the pop-up pyramid embodiment of FIG. 16A.

FIG. 16A is a perspective view of a popup pyramid 501 according to an embodiment of the present invention. FIG. 16B is a perspective view of pop-up pyramid 501 according to a variation of the embodiment of FIG. 16A. As is described with respect to the other pop-up assemblies discussed above, the pop-up pyramid structure 501 referenced in FIG. 16A may be created from a stock paper or cardboard material, a thin fordable plastic or other materials that are semi rigid and can take a fold. In other embodiments, the components may be made of differing materials or a combination of materials generally known in the art for use with pop-up structures. Pop-up pyramid structure 501, may be created from a flat cut pattern 502 that is folded along specific score lines (fold lines) and then glued at strategic points to make a pyramid shape. A second flat and cut pattern (not illustrated) adapted to help enable a center partition having a friction track that is length adjustable may be glued onto the pyramid pattern to provide a friction mechanism described below enabling the structure 501 to be moved from a collapsed generally two dimensional position into an open generally three dimensional position, held open and then moved from open position back to a generally flat closed position. It should be noted that the term "score lines" as used herein may refer to machine or manually created creases in the material allowing easy folding along the line. But the term "score line" also refers to any type of fold line (scored or not) and, in some embodiments, the score line is simply a solid or dotted inked line showing the user where the fold is to be made. Further, use of the word "glued" herein should be generally interpreted as being affixed to either through use of glues, adhesives, or fasteners well known and used in the art.

Pop-up pyramid structure 501 is a four sided pyramid embodiment of the present invention and is referred to herein as pyramid 501. Specifically, pyramid 501 is a four-sided pyramid in this example that includes four adjacent triangular shaped triangles with bottom edges and a shared radial point at the top. Other embodiments of the present invention may be in the form of other three dimensional geometrical shapes having opposing sides such as a square, rectangle, rhombus, trapezoid, or pyramid with flat top, that can be folded flat along opposing score lines. Pyramid 501 as shown has four adjacent flat exterior walls and four exterior corners. In this embodiment, the exterior corner 503 is created by gluing the outside edge of the first panel to the outside edge of the fourth panel, the remaining exterior three corners are located along folded score lines (folding lines) between adjacent exterior panels. An interiorly located center partition is not visible in this view because it is in direct line of view between corner 503 and the opposite corner. In this embodiment, pop-up pyramid 501 may be used as a display mechanism for displaying an otherwise loose card or token piece 504*a* that may have a text message, title, art, photo, moniker or other visual content deemed appropriate for display.

Examples of use of pop-up pyramid 501 may include place markers, card display prop, table centerpiece, industrial caution cone (paper), art display, science exhibit structure, etc. Pyramid 501 as shown may be about three inches across from exterior panel wall to opposite exterior panel wall and about six inches high from floor to point for a table setting piece but may also be manufactured in larger or smaller sizes without departing from the spirit and scope of the present invention. Card (medallion) 504*a* is a loose accessory that may be attached to or otherwise positioned and staged on the pyramid body by partly inserting the bottom edge of card 504*a* into a lateral slot 505*a*. Card 504*a* may be paper, cardboard, plastic, or other stiff or semi-rigid material that is sufficiently thin enough to be frictionally inserted into slot 505*a*, which in this case is provided laterally through an exterior panel wall of pyramid 501. In alternative embodiment, the card or medallion 504*a* could be glued or otherwise attached directly to the exterior of the pyramid without need for vertical or lateral slots. In other alternative embodiments, the attached ornamental object may be something other than a card, such as a flower or other object with flap or fastener that can be hung or attached on the exterior of the pyramid structure.

Referring now to FIG. 16B, pyramid 501 may include a vertically running slot or slots such as slot 505*b* in addition to or in place of lateral slot 505*a* of FIG. 16A. Slot 505*b* is shown to be placed vertically down through edge, in this case, edge 503 (reinforced) of pyramid 501 into the material adjacent to the edge. This technique presents a smaller footprint for display with a better vertical alignment. Pyramid 501 has card or token 504*b*, card 504*b* fits into slot 505*b*. In this embodiment, slot 505*b* is cut to a depth that creates the angular width to hold the card firmly in place. Slot size may vary for different size accessory cards, medallions, tokens, etc. In one embodiment, a slot may be placed laterally across the top of pyramid 501 and a card like card 504*b* may be displayed at the very top of pyramid 501. Additional embodiments may have slits, slots, holes or other attachment mechanisms known in the industry for attaching cards, medallions, or other ornamental attachments at different locations and at different angles on the exterior structure without departing from the scope and spirit of the invention.

Figure 17A:
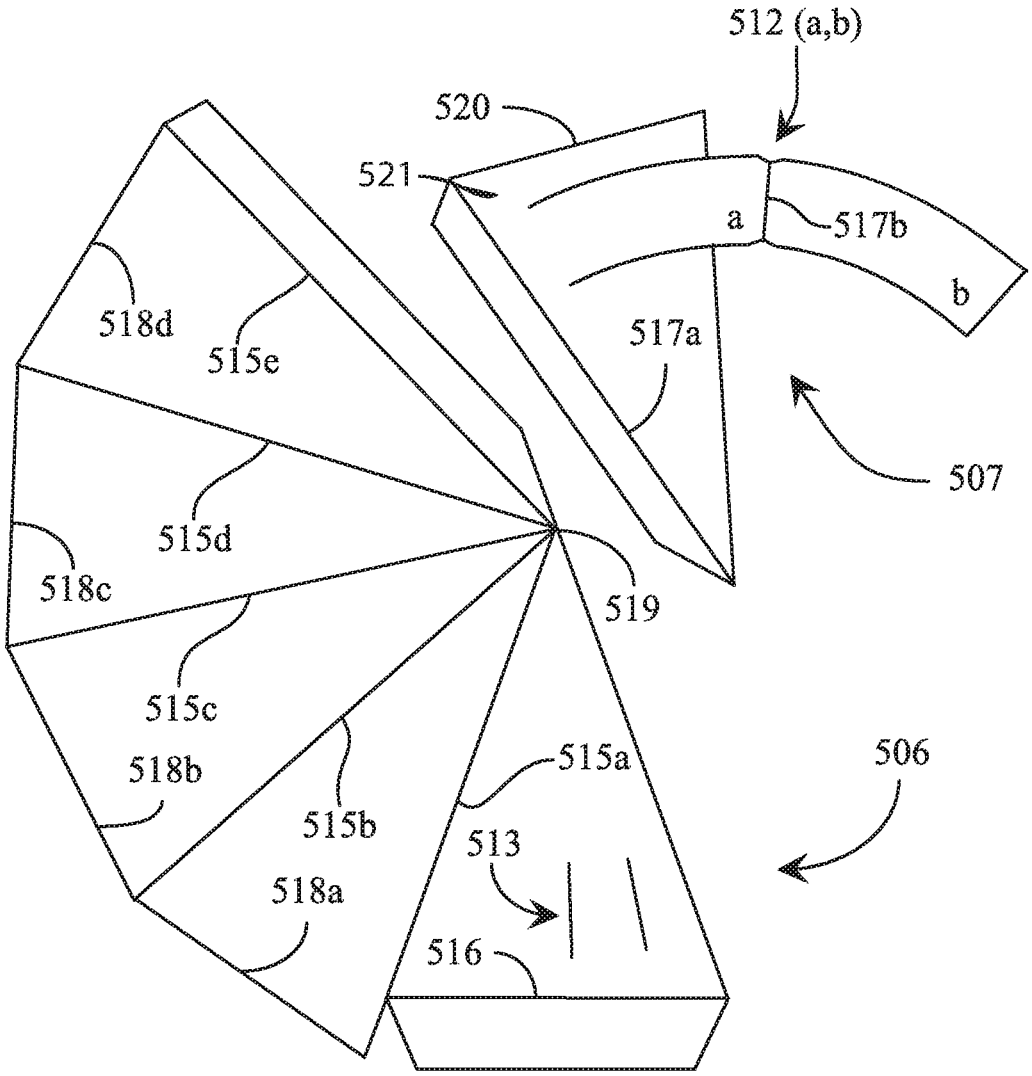
FIG. 17A is an overhead view of a radial pyramidal pattern and a separate radial pattern for creating the pop-up pyramid embodiment of FIGS. 16A and 16B.

FIG. 17A is an overhead view of a radial pyramidal pattern and a separate pattern for completing the center partition and contact friction mechanism for the pop-up pyramid of FIGS. 16A and 16B. In this view, a pyramid pattern 506 is created from a central radius point 519. Pattern 506 includes angularly measured score lines 515*a* through 515*e* defining four exterior triangular wall panels. Each of the exterior wall panels has a base or bottom edge that interfaces with the ground when the pyramid is popped out. These edges are pyramid bottom edges 518*a* through 518*d*. It should be noted that what is described as a center partition is really two opposing components extending from opposing interior corners, those components including the fifth panel 508*a* (shown in FIG. 17B) and panel 521 which is the triangular panel of 507. Together, the center partition 508*a* containing receiving slots 513 and the opposing center partition 507 having the curved frictional strap (512*b* overlapping 512*a*) extending through the receiving slots 513 together occupy a substantially vertical plane extending diagonally between opposing corners of the four sided pyramid profile, the profile having equal sides. Note that in some alternative embodiments, the profile may not have equal sides but instead have equal opposing exterior sides or panels.

As shown in FIG. 17A, pattern 506 includes a fifth panel 508*a* defined as sharing score line 515*a* that includes a pair of slots 513 placed there through and has a bottom flap defined by score line 516. This panel forms part of a central partition that presents internally and bridges opposing corners of the pyramid. Pattern 507 is a separate flat pattern that defines an opposing part of the central partition with sliding frictional strap or tab (formed by folding 512*b* over 512*a* along score line 517*b*) for enabling the combined center partition to lengthen during collapse of the pyramid and to halt the opening of the pyramid at the fullest three-dimensional form during pop-out and hold it in open position. Pattern 507 includes a score line 517*a* defining the edge of a glue flap 509 used to attach pattern 507 to pattern 506 in the proper strategic position to enable assembly. Pattern 507 is a triangular shape having a base (bottom) edge 520. In full assembly, base edge 520 and score line 516 present at a higher elevation than the four base (bottom) edges 518*a* through 518*d* of the pyramid.

In one embodiment there may be more pyramidal walls than four without departing from the spirit and scope of the present invention. As previously noted, other geometric alterations may also be applied to change the shape, diameter, height, and number of walls of the pop-up structure without departing from the spirit and scope of the invention. Pattern 507 includes a frictional strap 512(*a,b*) where a and b represent opposite sides of score line 517*b*. For example, section 512*b* is folded over section 512*a* to thicken the material and create more friction as it is threaded through slot pair 513 when assembling and gluing the pyramid pop-up structure. It should be noted that frictional strap 512*a* is an extension from interior extension 521. The lines shown on FIG. 17A defining frictional strap portion 512*a* are cut lines. Thus, the base of frictional strap 512*a* extends from interior extension 521 beginning closer to glue tab 509. This allows the opposing interior extension 508*a* reference on FIG. 17B to slide behind or in front of 521 as the frictional strap 512*a* and 512*b* extends through the slots 513 when the assembly is moved into open position. One will note that the size and positioning of slots 513 enable the curved frictional strap 512*a* and 512*b* to slide easily through the slots 513. The slots are far enough apart to allow the curved strap to maintain a strong enough hold in open position to resist closure caused by elasticity of the folded materials. The slots are also located close enough to the outside edge of 508*a* to maintain the frictional strap (512*a* and 512*b*) within the slots at time of closure.

Figure 17B:
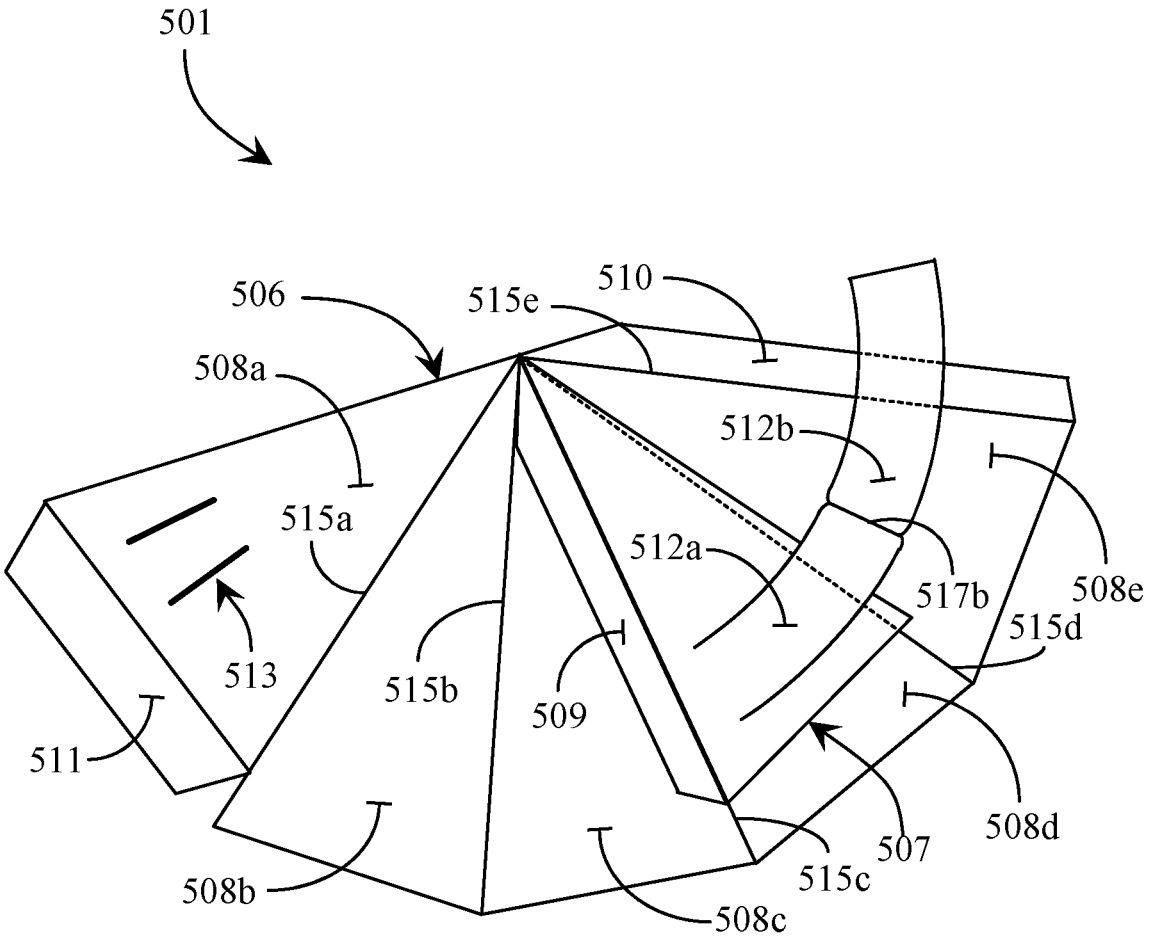
FIG. 17B is an overhead view of the patterns of FIG. 17A positioned and glued together to create the complete three-dimensional pop-up pyramid embodiment of FIGS. 16A and 16B.

FIG. 17B is an overhead view of the patterns of FIG. 17A positioned and glued together to create the complete three-dimensional pop-up pyramid. Referring now to FIG. 17A, pop-up pyramid structure 501 is created from at least one pattern. In this embodiment, the two flat patterns 506 and 507 are used to create a pyramid structure that includes a center partition which, again, is a combination of overlapping opposing structures 508*a* and 521 with frictional strap that together serves as a frictional adjustment mechanism for opening and closing the structure relative to three-dimensional shape. Flat pattern 506 is adapted to be folded and glued to create the pyramid shape, and pattern 507 is adapted to be folded and glued, including attached to pattern 506 to create opposing center partition walls with frictional strap that functions as a frictional contact mechanism for applying frictional contact to help keep pop-up pyramid 501 open when assembled and glued and popped up by a user and closed when subsequently collapsed by a user. Without a frictional contact mechanism, the three-dimensional pyramid could not hold shape when open or stay completely flat when closed or collapsed in on itself. Flat pattern 507 is depicted in this view as assembled strategically to flat pattern 506 to present on the inside of the pyramid shape and to form, once assembled, a center partition extending between opposing corners of the pyramid as will be further illustrated later in this specification.

In this embodiment, flat pattern 506 includes a far left (from view perspective) triangular (isosceles) panel 508A that may form a center sliding partition enabled by the frictional contact mechanism and modifications to the panel. Panel 508*a* has a folding flap 511 cut and formed laterally along a score line functioning as the base edge of the triangle. Panel 508*a* is defined on the right edge by a score line 515*a* culminating at the top at a central radius point for the pattern.

Triangular panel 508*a* includes a pair of elongate slots 513 arranged somewhat orthogonally to the base (bottom edge) of panel 508*a* and spaced apart to form a loop through which an extension, in this case a frictional strap created by overlapping curved sections 512*a* and 512*b* of 521, may be inserted through and fictionally held in position therein. Score line 515*a* defines the left side of an adjacent triangular panel 508*b* that forms the first exterior side of the four-sided triangle. Triangular panel 508*b* is somewhat more acute in angle than triangular panel 508*a* because of its exterior position as one of four pyramid exterior walls all having the same angularity at the point angle and base angles. In this embodiment, triangle 508*b* has a point angle that is 30 degrees and base angles that are 75 degrees each. Other angular relationships may be observed to create wider or narrower pyramid shapes without departing from the spirit and scope of the invention. Triangular panel 508*b* shares a score line 515*b* with triangular panel 508*c*. Triangular panel 508*c* shares a score line 515*c* with triangular panel 508*d*, triangular panel 508*d* shares a score line 515*d* with triangular panel 508*e*.

Triangular panels 508*b* through 508*e* are the four walls of pop-up pyramid 501 and are dimensionally consistent as shown. Triangular panel 508*e* shares a score line 515*e* with a glue flap 510. Glue flap 510 interfaces with triangular panel 508*a* forming the central partition and is folded inward and is glued to align with score line 515*e* to score line 515*a* to permanently close the pyramid once the frictional contact mechanism is assembled. When assembled, score line 517*a* of 507 as shown in FIG. 17A aligns with fold line 515*c*.

Pattern 507 is a triangular shape somewhat shorter in length than panels 508*b* through 508*e* having a score line aligned over score line 515*c* that separates the triangle shape from a glue flap 509. Glue flap 509 is glued or otherwise attached on the back side to the surface of triangular panel 508*c* aligned with the score lines and at the top central radius point 519 on FIG. 17A. The opposite side of pattern 507 is not glued down and therefore may be angled upward to vertical position. Pattern 507 includes a frictional strap or extension 512 (sides a and b), referenced herein as a section 512*a* and an adjacent section 512*b* set apart by a shared score line 517. A user may fold section 512*b* over section 512*a* and glue them together to form a sturdy frictional strap for inserting into slot pair 513 in order to produce the required friction to keep pyramid 501 open (popped up) or closed when collapsed by a user. In alternative embodiments, the overlapping portions of the frictional strap 512*a* and 512*b* do not need to be glued of otherwise affixed together although doing so strengthens the strap and prevents unwanted kinking during use. In alternative embodiments, the frictional strap may be made of a thicker material than the other portions of the pop-up. Pattern 507 presents on the right inside surface of pattern 506 and provides a portion of the central friction partition with panel 508*a*. Frictional strap 512(*a,b*) are drawn and cut along an arc, in one embodiment as shown, to increase frictional properties of the strap. In alternative embodiments, the frictional strap is straight and extends perpendicularly from the outside edge of panel 521. The frictional strap slides within the slots as the structure is opened and closed and thus may be otherwise referred to herein as a sliding frictional strap or frictional sliding strap.

FIGS. 17A and 17B show the pattern and components that may be combined together to create the pop-up structure shown in FIGS. 16A and 16B. This embodiment of the pop-up assembly has four triangular adjacent exterior planar panels 508*e*, 508*d*, 508*c*, and 508*b* making up the exterior walls of the four sided pyramid. The first panel 508*e* having a first folding edge (score line) 515*d*, a second panel 508*d* having a second panel edge connected to the first panel along the first folding edge 515*d* and having a second folding edge 515*c* opposite the first folding edge, a third panel 508*c* having a third panel edge connected along the second folding edge 515*c* and having a third folding edge 515*b* opposite the second folding edge, a fourth panel 508*b* having a fourth panel edge connected along the third folding edge 515*b* and having a fourth folding edge opposite the third folding edge 515*a*, a center partition panel 508*a* connected along the fourth folding edge, and comprising one or more receiving slots for accepting a protruding frictional sliding strap or tab extending from the opposite interior corner from center partition panel 508*a*, wherein all the exterior planer panels 508*e*, 508*d*, 508*c* and 508*b* as well as center partition panel 508*a* are folded in the same direction along the first, second, third, and fourth folding edges (score lines), the center partition panel 508*a* being folded along the fourth folding edge 515*a* and extending from the one interior corner toward the opposite interior corner, the opposing center partition panel 521 having a curved protruding frictional sliding strap 512(*a* and *b*) affixed to the interior surface of exterior panel 508*c* and adjacent the second folding edge 515*c* and extending toward the opposite interior corner 515*a* such that a curved protruding frictional tab extends through the one or more receiving slots 513 of center partition panel 508*a* thereby enabling the pyramid to pop out into a three dimensional structure and resist collapse and also enabling the pyramid to fold back into two dimensions. One will note that the opposing center partition panel 521 is triangular in shape as shown with extending frictional strap. In alternative embodiments the panel 521 is omitted and the frictional strap simply extends from the corner. However, the overlapping triangularly shaped opposing center partition members 508*a* and 521 work together to create a stronger stop when the pop-up is moved to open position and having a panel 521 strengthens the frictional strap.

Figure 18A:
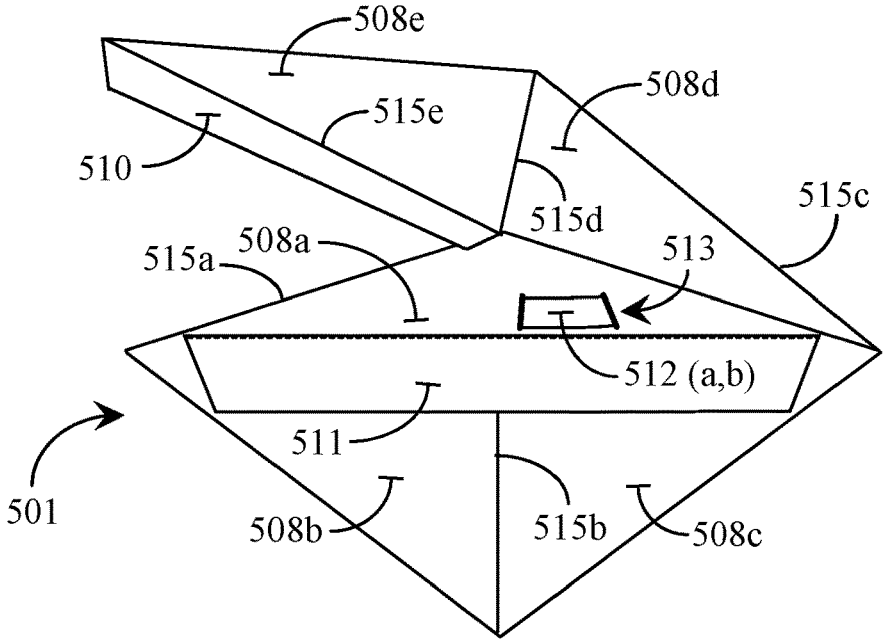
FIG. 18A is a perspective view from the bottom of the pop-up pyramid embodiment of FIGS. 16A, 16B, 17A and 17B in a state of partly folded and partly glued.

FIG. 18A is a perspective view from the bottom side of the assembled pop-up pyramid 501 of FIGS. 16*a* and 16*b* in a state of partly folded and partly glued. Pop-up structure 501 is partly folded in this example to depict triangular panel 508*a* in a horizontal position and extension or frictional strap 512(*a,b*) where 512 b is folded over 512*a* and glued to form a thicker strap for creating more friction through slots 513. Note that the callout 513 on FIG. 18A refers to both slots of 508*a*. In an alternative embodiment, more than two slots may be used to provide the adequate amount of friction to hold the pop-up in open and closed position. Increasing the number of slots through which the frictional strap is inserted increases the friction and may be preferable for pop-ups of greater size or requiring greater tension and strength to hold open. The only dimensional requirement for slot pair 513 is that the slots are each long enough to accept the width (including arc) of the frictional strap. However, note that the slots are positioned relative to each other such that they easily coincide with the curvature of the frictional strap. In some embodiments, the curve of the frictional strap may be increased and the slots would be positioned accordingly to accept the increased strap curvature.

Folding flap 511 is depicted hanging down at a right angle from panel 508*a* for view purposes, however once frictional strap 512*a* and 512*b* is fully inserted into slot pair 513, flap 511 is folded up inside to provide more rigidity. Flap 511 may be left unglued so as not to be glued to the frictional strap 512(*a,b*), or it may be glued, or otherwise fastened, at one or more strategic locations that do not contact the frictional strap that is meant to slide through slot pair 513 when opening and closing pyramid 501, nor the host pattern material. Flap 511 has angled or otherwise beveled ends creating a shape that that fit into the corners of the pyramid when the flap is folded upward on the interior of the pop-up. The length of flap 511 provides a stronger stop point for popping out the three-dimensional form to the full volume of the form. One will note, however, that the width of panels 508*a* and 521 when overlapping also provide a stop and otherwise support the upper portions of the pyramid when in open position. When assembling frictional strap 512(*a,b*) onto panel 508*a*, it may enter the first slot from behind and then be inserted back through the second slot, the material between the slots functions as a tight loop to hold the strap in place via contact friction. Glue flap 510 may be folded under in the preferred embodiment and glued along the edge of panel 508*a* along score line 515*a*. Score line 515*e* and score line 515*a* form the glued long edge of pyramid 501. All the other long edges of pyramid 501 are folded pattern score lines.

Figure 18B:
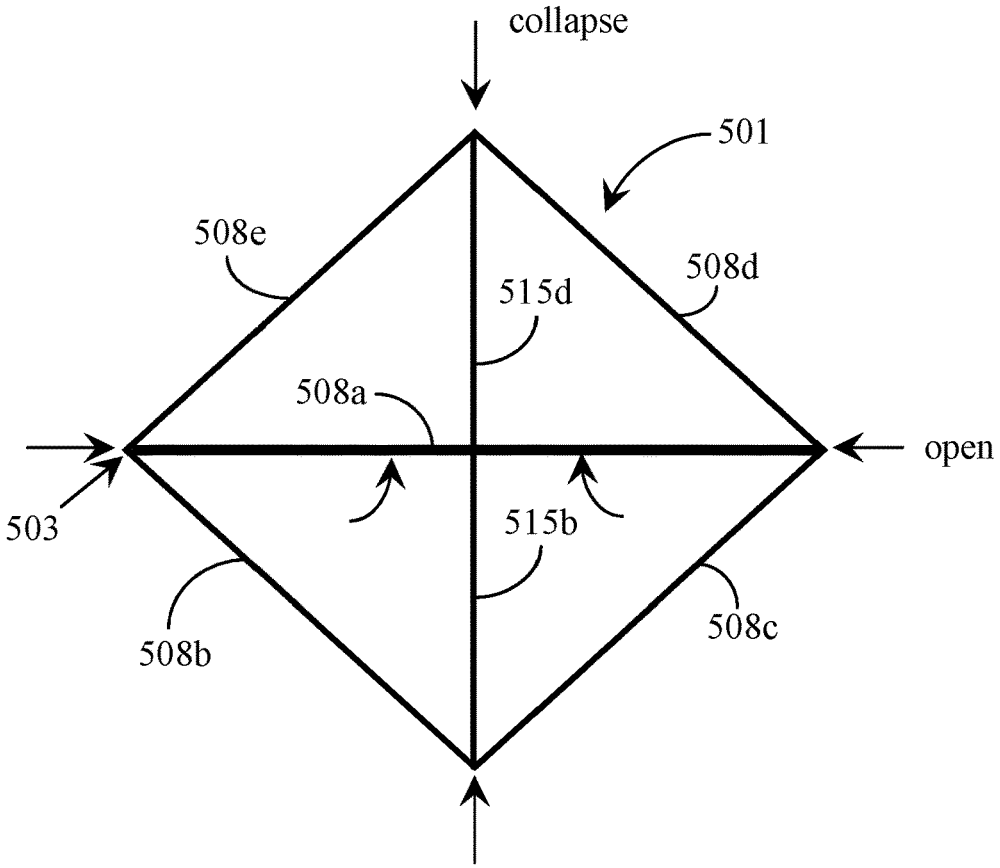
FIG. 18B is an underside view of the pop-up pyramid embodiment of FIGS. 16A, 16B, 17A and 17B opened to full three-dimensional form.

FIG. 18B is an underside view of pop-up pyramid 501 of FIG. 16 opened to full three-dimensional form. Pyramid 501 viewed from the underside depicts panel 508*a* with flap 511 folded there over as indicated by arrows to form a relatively thick frictional partition comparing to single material thickness of the pattern materials. The doubling of thickness of frictional strap 512(*a,b*) and reinforcement using flap 511 to fold back over the panel provides a three dimensional pop-up structure that adheres to open position and that will remain flat due to frictional contact. In one embodiment, the pattern extends in length to include additional flaps at the bottom edges of at least one of the triangular exterior panels that may be used to provide a cover for the bottom of the pyramid, for example, a base extension such as 320 with complementary slot 309 shown and described in reference to the house embodiment of FIG. 11.

In this embodiment, a user may apply opposing force on the vertical corners of pyramid 501 to collapse the form back to a relatively flat state for storage. A user may apply opposing force on the horizontal corners on a flat pyramid to open it to full volume where it stops moving due to the reinforced partition, specifically flap 511 in fold over position as well as the width of 508*a*. In this embodiment, frictional strap 512(*b* folded over *a*) contacts the inside corner of pyramid 501 when fully opened. Therefore, both the frictional strap 512(*a,b*) and flap 511, as well as the width of 508*a* and overlapping opposing panel 521, provide stop reinforcement to prevent collapse past the full volume of the structure. In this way it may only be collapsed at those corners having no partition bridging them.

In this example, the pattern-based panel 508*a* and opposing panel 521 serves as a center partition and becomes part of the pop-up frictional mechanism and stop bridge. The remaining four subsequent panels sharing score lines make up the four exterior side walls of pyramid 501. In one embodiment any number of the four pyramid panels may be slotted through to an extent laterally that permits a user to partly insert a card, ticket, photo, bill, reservation, or other visual media into the slot.

Figure 19A:
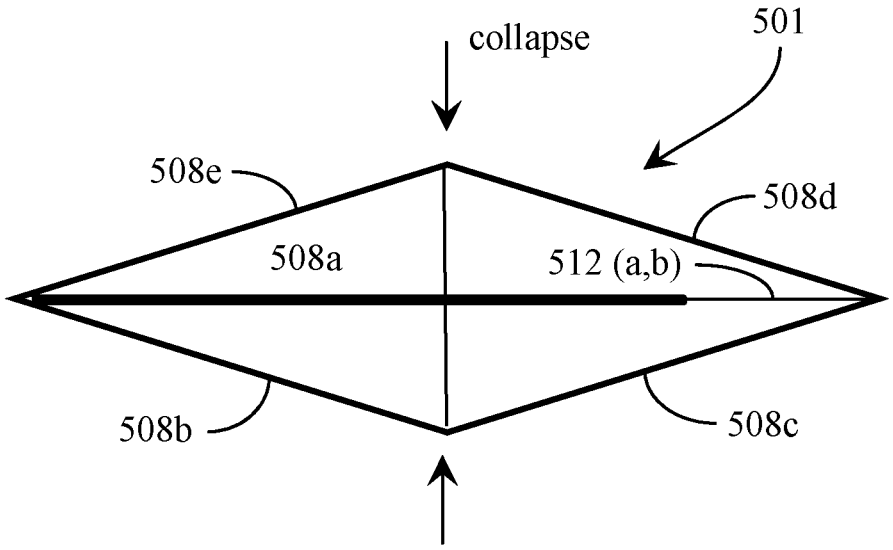
FIG. 19A is an underside view of the pop-up pyramid embodiment of FIGS. 16A, 16B, 17A, 17B, 18A, and 18B partly collapsed.

FIG. 19A is an underside view of pop-up pyramid 501 of FIG. 16 partly collapsed. In this view, pyramid 501 is being collapsed by a user applying opposing force at the vertical corners as directed in this view by directional arrows. As pyramid 501 collapses, panels 508*b* through *e* collapse in over the central friction partition. As opposing corners collapse, the bridged corners move further from center causing the opposing panels of the center partition 508*a* and 521 and I frictional strap 512(*a,b*) to slide out to a point to enable full collapse without the frictional strap being removed from slot pair 513. Contact friction caused by frictional strap 512(*a,b*) is stronger than gravity, material resiliency, etc. A user may move the frictional mechanism as described with little effort and once opened, the reinforced structure remains at full three-dimensional volume until collapsed purposely by the user.

Figure 19B:
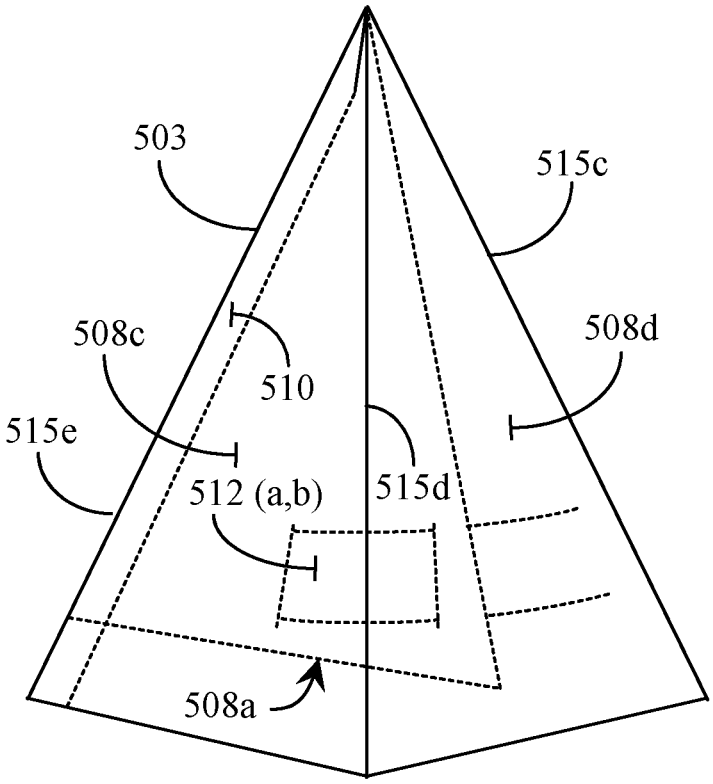
FIG. 19B is a side-elevation view of the pop-up pyramid embodiment of FIGS. 16A, 16B, 17A, 17B, 18A,and 18B fully collapsed for storage.

FIG. 19B is a side-elevation view of pop-up pyramid 501 of FIG. 16 fully collapsed for storage. In this view, the glued long exterior edge 503 is at left from this view perspective. Glue flap 510 is depicted in broken line along with panel 508*a* and inserted frictional strap 512(*a,b*). Panels 508*c* and 508*d* are the two of the four external panels visible in this fully collapsed view. Score lines 515*e*, 515*d*, and 515*c* are visible in this view. It is important to note herein that pyramid panel 508*a* and panel 521 of pattern triangle 507 overlap when assembled to form the structure enabling the friction mechanism.

Figure 20:
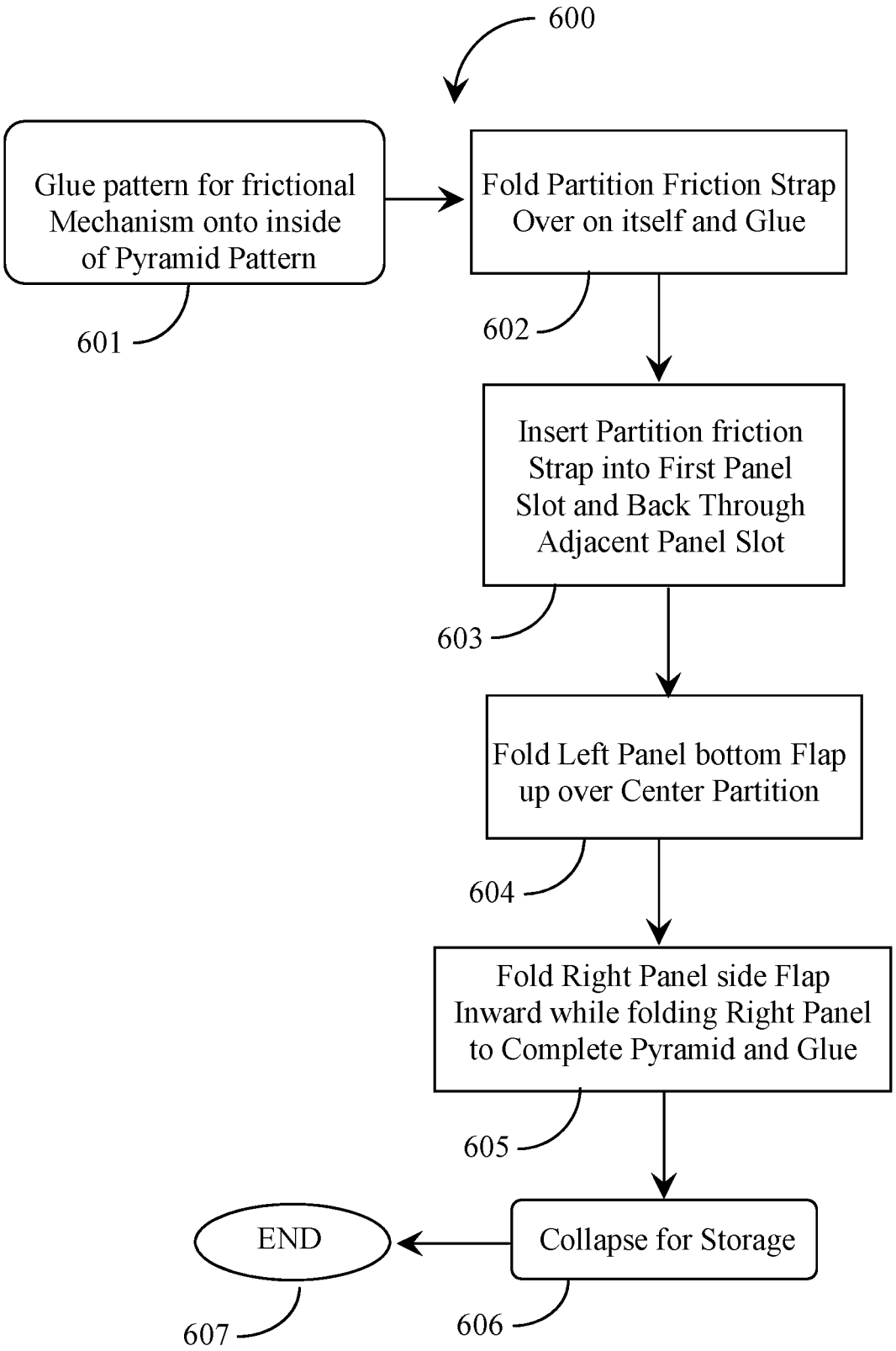
FIG. 20 is a process flow chart depicting steps for assembling a pop-up pyramid embodiments from patterns shown in FIGS. 17A and 17B.

FIG. 20 is a process flow chart 600 depicting steps for assembling a pop-up pyramid structure from separate patterns according to an aspect of the present invention. Note that with regard to the steps described in FIG. 20, the "first panel" refers to panel 508*a* whereas the "first panel" referenced with respect to the description of FIG. 17A and 17B above, refer to panel 508*e*. At step 601 a user may position and glue or otherwise attach the opposing center partition panel 521 with frictional strap 512 (together, pattern 507 on FIGS. 17A and 17B) onto the main pyramid pattern depicted in FIGS. 17A and 17B relative to patterns 506 (pyramid) and 507 (opposing center partition and strap component). At step 602, the user may fold the frictional strap over on itself relative to components 512*a* and 512*b* of pattern 507 of FIGS. 17A and 17B.

At step 603, the user may insert the partition frictional strap of 507 into the first slot (513 on FIGS. 17A and 17B) of panel 508*a* and back through the adjacent panel slot. This step connects the frictional mechanism and enables the pyramid to maintain the full volume three-dimensional pop-up open position. At step 604, the user may fold the left panel (center partition panel 608*a*) bottom flap analogous to flap 511 of FIGS. 17A and 17B over the opposing central partition. At this step gluing is not required as no glue contact is desired for the moving parts. However, it might be strategically glued as to allow for movement of the frictional strap and pattern body host.

At step 605, the user may fold the right panel glue flap analogous to flap 509 of FIGS. 17A and 17B inward while folding the panel over and gluing it (509) to the inside surface of the wall panel 508*c* to complete the pyramid shape. This step should be performed with force applied to fully insert the frictional strap through the slot pair to stop. At this point the pyramid is fully popped out (full volume). At step 606, the user may collapse the pop out pyramid back to a flat state for storage. The process may end at step 607. In an alternative method, step 605 (the attachment of 507 to the interior surface of the pyramid using glue flap 509) can be performed before inserting the friction strap through the slots as described in step 603. In an alternative method, card or other ornamental feature can be attached (as described in reference to FIGS. 16A and 16B) to the exterior surface of the pyramid once in the pyramid is constructed and in open position.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. For example, the different external structure designs and dimensions for the same may be varied. Further, the steps used to describe the method for making the various example embodiments may be performed in different order and the number of steps may differ depending on the complexity (i.e. number of elements) associated with each example structure. Thus, the scope of the present invention should not be limited to the structures described herein, but only by the structures and methods described by the language of the claims and their equivalents.

The invention claimed is:

1. A pop-up assembly, comprising;

four triangular exterior wall panels having interior and exterior surface including;

a first panel having an outside panel edge and a first folding edge;

a second panel having a second panel edge connected to the first panel along the first folding edge and having a second folding edge opposite the first folding edge;

a third panel having a third panel edge connected along the second folding edge and having a third folding edge opposite the second folding edge;

a fourth panel having a fourth panel edge connected along the third folding edge and having a fourth folding edge opposite the third folding edge;

a center dividing panel connected along the fourth folding edge and having one or more slots for accepting a curved sliding frictional strap extending from an opposing center dividing panel extending from the opposite interior corner of the pyramid from the center dividing panel, wherein all of the exterior planer panels as well as the center dividing panel are folded in the same direction along the first, second, third, and fourth folding edges, the center dividing panel being folded along the fourth folding edge and extending from one interior corner toward the opposite interior corner, and opposing center dividing panel having frictional strap, the opposing center dividing panel affixed to the interior surface of the third exterior panel and adjacent the interior surface of the second folding edge and extending toward the opposite interior corner such that the frictional strap extends through the one or more slots of the center dividing panel thereby enabling the pyramid to pop-out into a three dimensional structure and resist collapse and also enabling the pyramid structure to fold back into two dimensions.

2. The pop-up assembly of claim 1, wherein as the assembly pops out to the three dimensional structure, the frictional strap translates within the one or more slots with enough friction to allow opening while maintaining the structure in open position.

3. The pop-up assembly of claim 1, wherein the frictional strap of the opposing center dividing panel extends directly from a glue tab affixed to the interior surface of the assembly.

4. The pop-up assembly of claim 1, wherein the frictional strap is curved.

5. The pop-up assembly of claim 4, wherein the one or more slots of the center dividing panel are oriented to accommodate the curved frictional strap.

6. The pop-up assembly of claim 1, where in the frictional strap is configured to allow it to be folded against itself to provide a double layer thickness as it extends through the one or more slots of the center dividing panel.

7. The pop-up assembly of claim 1, wherein the frictional strap extends horizontally through the one or more slots of the center dividing panel.

8. The pop-up assembly of claim 7, wherein the one or more slots of the center dividing panel are configured to accept a horizontally extending frictional strap.

9. The pop-up assembly of claim 1, wherein a combination of frictional strap and one or more slots of the center dividing panel are configured to allow the assembly to pop out into a three dimensional structure while resisting collapse.

10. The pop-up assembly of claim 1, wherein a combination of frictional strap and one or more slots of the center dividing panel are configured to enable the assembly to fold from a three dimensional structure into two dimensions.

11. The pop-up assembly of claim 1, wherein the center dividing panel and opposing center dividing panel are overlapping when the assembly is popped out into a three dimensional structure.

12. The pop-up assembly of claim 1, wherein the center dividing panel and opposing center dividing panel work together to create a stop when the pop-up is moved into a fully open three dimensional structure.

13. The pop-up assembly of claim 1, wherein one or more exterior panels includes one or more slots for accepting indicia.

14. The pop-up assembly of claim 13, wherein the one or more slots are configured for accepting any one of a card, ticket, photo, bill, or reservation.

15. The pop-up assembly of claim 1, wherein the exterior of the assembly is configured for attachment of indicia.

16. The pop-up assembly of claim 1, wherein the assembly may be easily collapsed by a user applying force at the opposing corners where the center dividing panel and opposing center dividing panel are attached with the interior of the assembly.

17. The pop-up assembly of claim 1, wherein the assembly may be closed into two dimensional structure without the frictional strap being removed from the one or more slots of the center dividing panel.

* * * * *